US008291879B2

(12) United States Patent
Eakins, Jr.

(10) Patent No.: US 8,291,879 B2
(45) Date of Patent: Oct. 23, 2012

(54) RECOIL STARTER SYSTEM

(75) Inventor: Charles Arthur Eakins, Jr., Liberty, SC (US)

(73) Assignee: Techtronic Outdoor Products Technology Limited, Hamilton (BM)

( * ) Notice: Subject to any disclaimer, the term of this patent is extended or adjusted under 35 U.S.C. 154(b) by 483 days.

(21) Appl. No.: 12/700,321

(22) Filed: Feb. 4, 2010

(65) Prior Publication Data

US 2010/0170465 A1 Jul. 8, 2010

Related U.S. Application Data

(63) Continuation-in-part of application No. 12/398,582, filed on Mar. 5, 2009, now Pat. No. 8,132,553.

(60) Provisional application No. 61/119,627, filed on Dec. 3, 2008.

(51) Int. Cl.
*F02N 1/00* (2006.01)

(52) U.S. Cl. ..... 123/185.3; 123/185.2; 123/185.14

(58) Field of Classification Search ..... 123/185.2, 123/185.3, 185.7, 185.14
See application file for complete search history.

(56) References Cited

U.S. PATENT DOCUMENTS

| | | | | |
|---|---|---|---|---|
| 2,804,173 | A | | 8/1957 | De Millar |
| 2,869,682 | A | | 1/1959 | De Millar |
| 2,999,489 | A | | 9/1961 | Coughlin et al. |
| 3,084,679 | A | | 4/1963 | Brown et al. |
| 3,140,703 | A | | 7/1964 | Barr |
| 3,165,100 | A | | 1/1965 | Svendsen |
| 3,306,277 | A | | 2/1967 | Gudmundsen |
| 3,332,410 | A | | 7/1967 | Dwyer, Jr. |
| 3,692,010 | A | * | 9/1972 | Dooley et al. ..... 123/185.14 |
| 3,739,763 | A | * | 6/1973 | Berry et al. ..... 477/99 |
| 3,858,566 | A | | 1/1975 | Perry |
| 4,127,098 | A | * | 11/1978 | Frers et al. ..... 123/185.3 |
| 4,167,929 | A | * | 9/1979 | DuBois ..... 123/185.1 |
| 4,658,775 | A | * | 4/1987 | Greenwood et al. ..... 123/185.3 |
| 5,256,091 | A | * | 10/1993 | Haman et al. ..... 440/85 |
| 5,287,832 | A | | 2/1994 | Uhl |
| 5,431,135 | A | | 7/1995 | Tyler |
| 5,537,966 | A | | 7/1996 | Ohnishi |
| 5,826,555 | A | | 10/1998 | Aronsson et al. |
| 6,230,678 | B1 | * | 5/2001 | Gracyalny et al. ..... 123/185.14 |
| 6,260,529 | B1 | * | 7/2001 | Gracyalny et al. ..... 123/185.14 |
| 6,755,170 | B2 | | 6/2004 | Morishige et al. |
| 6,782,863 | B2 | | 8/2004 | Leasure et al. |
| 6,834,633 | B2 | | 12/2004 | Sing et al. |
| 7,069,896 | B2 | | 7/2006 | Tsunoda et al. |
| 7,140,341 | B2 | | 11/2006 | Dahlberg |

(Continued)

*Primary Examiner* — Stephen K Cronin
*Assistant Examiner* — Johnny Hoang
(74) *Attorney, Agent, or Firm* — Michael Best & Friedrich LLP

(57) ABSTRACT

A recoil starter system. The system may include a drive member engageable with an engine, the drive member including a plate having a first spring support having a first outer surface with a first outer diameter, a pulley member rotatably coupled to the drive member and including a second spring support, the second spring support having a second outer surface with a second outer diameter, and a spring member coupled between the drive member and the pulley member, the first spring support and the second spring support cooperating to provide a radially-inner support for the spring member. The system may include a rotation limiting arrangement provided between the drive member and the pulley member, the rotation limiting arrangement including a pair of travel stops, and a rotation limiting member. The system may include a rope retention recess for receiving an end of the pull rope and a rope retention bar.

20 Claims, 42 Drawing Sheets

U.S. PATENT DOCUMENTS

| | | | | |
|---|---|---|---|---|
| 7,191,752 | B2 | 3/2007 | Schriever et al. | |
| 7,201,130 | B2 | 4/2007 | Hashiba | |
| 7,213,561 | B2 | 5/2007 | Hashiba | |
| 7,252,065 | B1 | 8/2007 | Keeton | |
| 2001/0006052 | A1* | 7/2001 | Gracyalny et al. | 123/185.14 |
| 2003/0094154 | A1 | 5/2003 | Morishige et al. | |
| 2006/0219204 | A1 | 10/2006 | Hashiba | |
| 2007/0131190 | A1 | 6/2007 | Hashiba | |
| 2010/0162985 | A1 | 7/2010 | Hashiba et al. | |
| 2010/0170465 | A1 | 7/2010 | Eakins, Jr. | |

* cited by examiner

RECOIL STARTER SYSTEM

CROSS-REFERENCE TO RELATED APPLICATIONS

This application is a continuation-in-part of U.S. patent application Ser. No. 12/398,582, filed Mar. 5, 2009, which claims priority to U.S. Provisional Patent Application Ser. No. 61/119,627, filed Dec. 3, 2008, the entire contents of both of which are hereby incorporated by reference.

FIELD OF THE INVENTION

The present invention relates to a recoil starter for an engine such as an internal combustion engine.

SUMMARY

A recoil starter is typically used in small internal combustion engines, such as a two stroke engine or a single cylinder configuration. Recoil starters generally include a pull cord wrapped about a pulley, the pulley being rotated by pulling on the pull cord. The rotational energy generated from the pull cord and pulley is transferred to the drive shaft of the engine through a ratchet and/or clutch mechanism. The rotation transferred to the drive shaft begins the engine cycle and starts the engine.

In operating such a starter, abrupt changes in the engine torque due to, for example, the compression of an air/fuel mixture by the piston and the cylinder in the engine may result in an uneven and jarring pulling force during starting and possibly even some kickback forces. These forces can make starting the engine difficult for a user, creating stresses that can even cause discomfort to the user.

Additionally, conventional starters have rotational limits due to the orientation of the internal springs and layout of the components. Some starters may also be prone to buckling and melting or welding due to misalignment during rotation of the two components with respect to one another. The structural shortcomings can lead to premature failure of the unit and/or "buckling" of the internal springs.

In some independent aspects and in some constructions, a recoil starter system may include a drive member engageable with an engine and including a first retainer, a pulley member supportable for rotation about an axis, the pulley member including a second retainer engageable with the first retainer to connect the pulley member to the drive member and to inhibit relative axial movement between the pulley member and the drive member, and a spring member coupled between the drive member and the pulley member.

In some constructions, one retainer includes a radially-extending annular lip, and the other retainer is engageable with the annular lip. The other retainer may include a plurality of retention members, each of the plurality of retention members being spaced apart about the axis and engageable with the annular lip. At least one retainer may be flexible to enable engagement of the retainers.

In some constructions, the spring member is connected to the drive member and to the pulley member and inhibits relative axial movement of the drive member and the pulley member. The spring member may include portions which engage the outer surfaces drive member and the pulley member to inhibit relative axial movement of the drive member and the pulley member.

In some independent aspects and in some constructions, a recoil starter system may include a drive member engageable with an engine, a pulley member supportable for rotation about an axis, and a spring member connected between the drive member and the pulley member to inhibit relative axial movement between the drive member and the pulley member.

In some constructions, when connected, the drive member and the pulley member may cooperate to define a cavity, and at least a substantial portion of the spring member is supported in the cavity. The drive member and the pulley member may each define an opening and a slot communicating with the opening, and an opposite end of the spring extends through each opening and is received in the associated slot. In some constructions, at least the pulley member further may include a spring support ramp engaging the spring for at least a portion of the spring circumference to inhibit unwanted motion of the spring member.

In some independent aspects and in some constructions, a method of assembling a recoil starter system may include engaging retainers to connect the pulley member to the drive member and to inhibit relative axial movement between the pulley member and the drive member, and coupling a spring member between the drive member and the pulley member.

In some constructions, engaging may include flexing at least one of the first retainer and the second retainer from a retention position, positioning at least the other of the first retainer and the second retainer for engagement, and returning the at least one of the first retainer and the second retainer to the retention position such that the first retainer and the second retainer are engaged to connect the pulley member and the drive member.

In some constructions, the recoil starter system may include a connecting arrangement to connect the system as a unit, and the connecting arrangement may be provided by the drive member and the pulley member. Also, in some constructions, when assembled, the drive member and the pulley member may be rotatable beyond 90 degrees with respect to one another.

In some constructions, the spring member may be configured to transmit force generated by the pulley member and to absorb and limit variations in the pulling torque produced by the engine, resulting in a smooth and constant pull force. Also, in some constructions, the spring member may provide at least a portion of the connecting arrangement.

In some independent aspects and in some constructions, a recoil starter system may generally include a drive member engageable with an engine, the drive member including a plate having a bottom surface, and a first spring support extending from the bottom surface of the plate, the first spring support having a first outer surface with a first outer diameter, a pulley member rotatably coupled to the drive member and including a second spring support, the second spring support having a second outer surface with a second outer diameter, and a spring member coupled between the drive member and the pulley member, the first spring support and the second spring support cooperating to provide a radially-inner support for the spring member.

In some constructions, the first outer diameter and the second outer diameter are substantially the same diameter. The second spring support may include a plurality of arcuate walls each extending along a portion of the second outer diameter.

In some constructions, the pulley member may further include a pair of spaced apart travel stops, and the drive member may further include a rotation limiting member extending from the bottom surface of the plate axially beyond the first spring support, the rotation limiting member moving between and engaging each travel stop to limit relative rotation between the drive member and the pulley member in each direction. The travel stops may be at least partially formed by the second spring support. The rotation limiting member may have a radially outer surface radially aligned with a corresponding portion of the outer surface of the first spring support.

In some constructions, at least one of the pulley member and the drive member includes one or more reinforcing ribs. The drive member and the pulley member define a cavity therebetween, the cavity having a height, and the first support member and the second support member may cooperate to extend substantially the height of the cavity.

In some constructions, the drive member may include a first retainer, and the pulley member may include a second retainer engageable with the first retainer to connect the pulley member to the drive member and to inhibit relative axial movement between the pulley member and the drive member. The spring member may be connected between the drive member and the pulley member to inhibit relative axial movement between the drive member and the pulley member.

In some independent aspects and in some constructions, a recoil starter system may generally include a drive member engageable with an engine, a pulley member rotatably coupled to the drive member, the drive member and the pulley member cooperating to define a cavity therebetween, a spring member coupled between the drive member and the pulley member, and a rotation limiting arrangement provided between the drive member and the pulley member. The rotation limiting arrangement may include a pair of travel stops supported by one of the drive member and the pulley member within the cavity, the travel stops being circumferentially spaced apart, and a rotation limiting member supported by the other of the drive member and the pulley member in the cavity, the rotation limiting member moving between and being configured to engage each travel stop to limit relative rotation between the drive member and the pulley member in each direction.

In some constructions, the one of the travel stops provides a first stop surface and the other of the travel stops provides a second stop surface, and the rotation limiting member has a first surface and an opposite second surface, the first surface being engageable with the first stop surface to limit relative rotation between the drive member and the pulley member in a first direction, the second surface being engageable with the second stop surface to limit relative rotation between the drive member and the pulley member in a second direction opposite the first direction. The first stop surface and the second stop surface may be circumferentially spaced apart by about 140 degrees. The travel stops may be supported by the pulley member, and wherein the rotation limiting member is supported by the drive member.

In some constructions, the drive member may include a plate with a bottom surface, and a drive member spring support extending from the bottom surface, the drive member spring support having an outer surface with an outer diameter, the drive member spring support providing a radially-inner support for at least a portion of the spring member, and the rotation limiting member may have a radial outer surface radially aligned with a corresponding portion of the outer surface of the drive member spring support. The pulley member may include a pulley member spring support having an outer surface with an outer diameter, the pulley member spring support providing a radially-inner support for at least a portion of the spring member, the travel stops being at least partially formed by the pulley member spring support.

In some independent aspects and in some constructions, a recoil starter system may generally include a drive member engageable with an engine, and a pulley member pivotably coupled to the drive member, the pulley member being rotatable by a pull rope, force generated by rotation of the pulley member is transmitted to the drive member, the drive member transmitting rotational force to the engine to start the engine, the pulley member including a body defining an outwardly-facing radial groove for receiving a wound portion of the pull rope, and a rope retention recess for receiving an end of the pull rope, the pull rope being arranged on the pulley member to extend from the first end in the rope retention recess and into the radial groove, the body providing a rope retention bar across and enclosing the rope retention recess to secure the end of the pull rope within the rope retention recess.

Independent features and independent advantages of the present invention will become apparent to those skilled in the art upon review of the following detailed description, claims and drawings.

Figure 1:
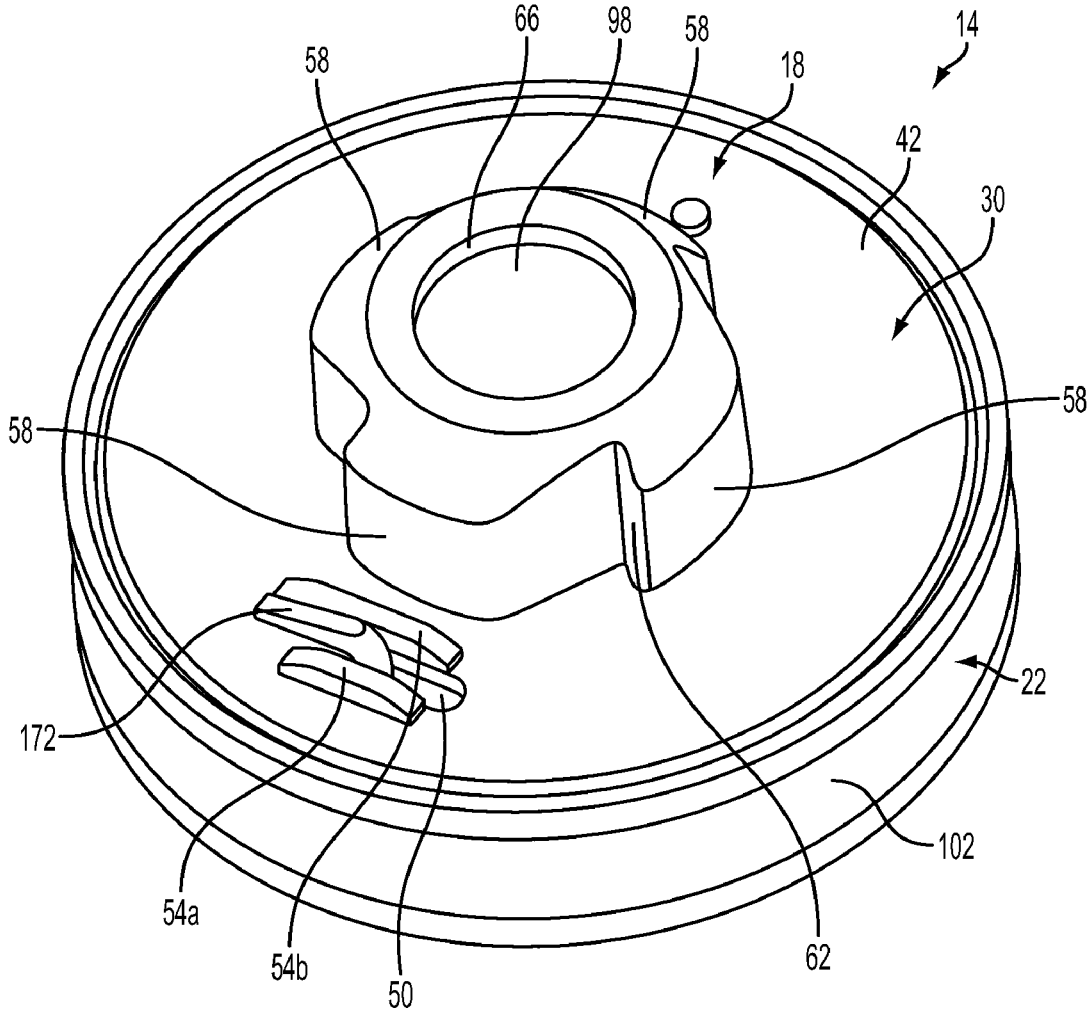
FIG. 1 is a top perspective view of a recoil starter system.

Before any independent features and at least one construction of the invention are explained in detail, it is to be understood that the invention is not limited in its application to the details of construction and the arrangements of the components set forth in the following description or illustrated in the drawings. The invention is capable of other constructions and of being practiced or being carried out in various ways. Also, it is understood that the phraseology and terminology used herein is for the purpose of description and should not be regarded as limiting. The use of "including", "having" and "comprising" and variations thereof herein is meant to encompass the items listed thereafter and equivalents thereof as well as additional items.

Although references may be made below to directions, such as upper, lower, downward, upward, rearward, bottom, front, rear, etc., in describing the drawings, these references are made relative to the drawings (as normally viewed) for convenience. These directions are not intended to be taken literally or limit the present invention in any form. In addition, terms such as "first" and "second" are used herein for purposes of description and are not intended to indicate or imply relative importance or significance.

DETAILED DESCRIPTION

FIGS. 1-6 and 21-26 illustrate recoil starter systems 14 and 14', respectively, for use with an internal combustion engine (not shown). As described below in more detail, the recoil starter system 14 generally includes a drive member 18 engageable with the engine, a pulley member 22 supportable for rotation about an axis A, and a spring member 26 coupled between the drive member 18 and the pulley member 22. The pulley member 22 is manually rotatable by means of, for example, in the illustrated construction, a pull rope (not shown) actuated by the operator. The force generated by the pulley member 22 is transmitted through the spring member 26 to the drive member 18, and the spring member 26 is able to absorb any fluctuations in the pulling requirements. The drive member 18 transmits the rotational force to the engine to start the engine.

U.S. Pat. Nos. 7,191,752 and 7,201,130 describe and illustrate recoil starters for use with an engine. With respect to the use and assembly of the recoil starter system 14 or 14' with an engine, the contents of these patents are hereby incorporated by reference.

As shown in more detail in FIGS. 5-9, the drive member 18 generally includes a main portion or plate 30, a ratchet portion 34 extending axially on one side of the plate 30 and configured to engage the engine (e.g., the flywheel of the engine via a clutch or ratchet mechanism (not shown)), and a support portion 38 extending axially on the other side of the plate 30.

The plate 30 has a first surface 42 and a second surface 46 and defines a recess 50 shaped to receive a portion of the spring member 26 (as described below). A slot 54 is defined adjacent the recess 50 by ridges 54*a*, 54*b* extending from the first surface 42 of the plate 30. The slot 54 communicates with the recess 50 and is shaped to receive and retain a portion of the spring member 26 (as described below).

In the illustrated construction, the ridges 54*a* and 54*b* are shown as two separate portions extending generally tangentially. In alternate constructions, the slot 54 may be configured with U-shape or as a covered slot 54 and/or may extend in another direction (e.g., radially). Also, in other constructions, the slot 54 may be defined at least partially into the first surface 42 of the plate 30. In such constructions, the ridges 54*a* and 54*b* may cooperate with the portion of the slot 54 formed in the first surface 42 or may not be provided.

The ratchet portion 34 extends substantially axially from the first surface 42 of the plate 30 and is engageable with a portion of the engine (e.g., a clutch or ratchet mechanism connected to a drive shaft). The ratchet portion 34 is generally cylindrical and includes a plurality ratchet teeth 58 (four ratchet teeth 58 in the illustrated construction). Each ratchet tooth 58 extends radially from the ratchet portion 34 and provides a contact surface 62.

Each ratchet tooth 58 is shaped to engage one of a plurality of pawls (not shown) of the clutch mechanism when rotated in a clockwise starting direction (in FIG. 8) and to spin freely with respect to the plurality of pawls when rotated in a counterclockwise recoil direction. The ratchet portion 34 is disconnected from the clutch mechanism during engine operation. The ratchet portion 34 and ratchet teeth 58 are formed of sufficient size, shape and number to provide, for example, adequate strength, engagement area, etc. to transmit input torque to the clutch mechanism without deformation or failure.

The ratchet portion 34 and the support portion 38 cooperate to define a central portion 66 of the drive member 18. The central portion 66 has a top wall 70 and a substantially cylindrical side wall 74. The top wall 70 supports the drive member 18 with respect to the pulley member 22 and defines an opening 78. The side wall 74 is sized to receive the pulley member 22 and to permit relative rotational movement between the drive member 18 and the pulley member 22. In alternate constructions, the inner diameter of the side wall 74 may be increased to allow clearance for bearings or other devices to facilitate relative rotation between the drive member 18 and the pulley member 22.

The support portion 38 extends axially from the second surface 46 of the plate 30, and a first retainer 80 extends radially from the support portion 38. In the illustrated construction, the first retainer 80 is configured as a continuous annular radial ridge. The first retainer 80 has an angled lead-in surface 82 and a retaining surface 86.

In alternate constructions (not shown), the first retainer 80 may include another configuration to provide a connection between the drive member 18 and the pulley member 22. For example, the first retainer 80 may be formed as one or more ridges extending about only a portion of the circumference of the support portion 38. The first retainer 80 may include a number of relatively narrow retaining tabs.

Figure 6:
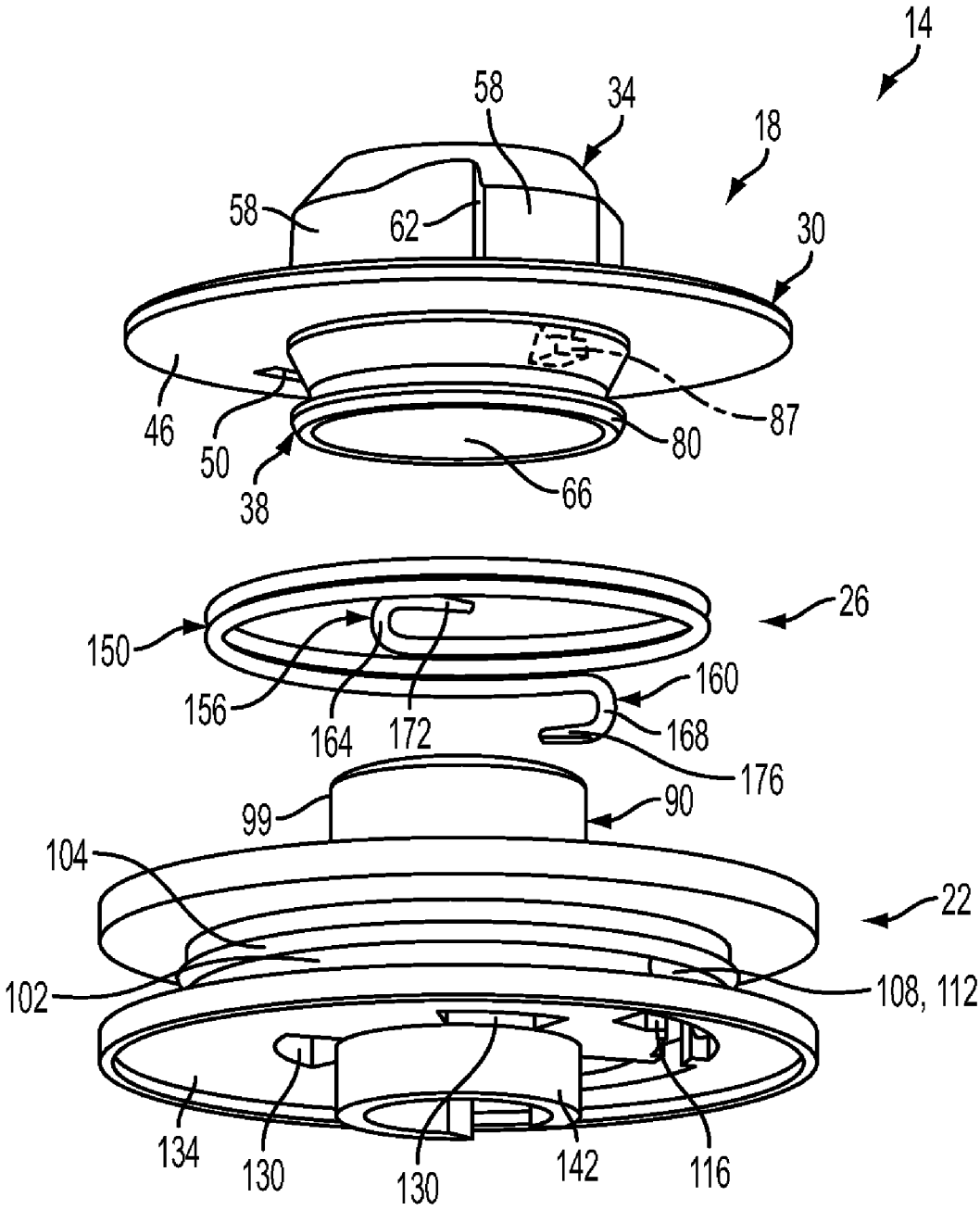
FIG. 6 is an exploded bottom view of the recoil starter system shown FIG. 1.
Figure 7:
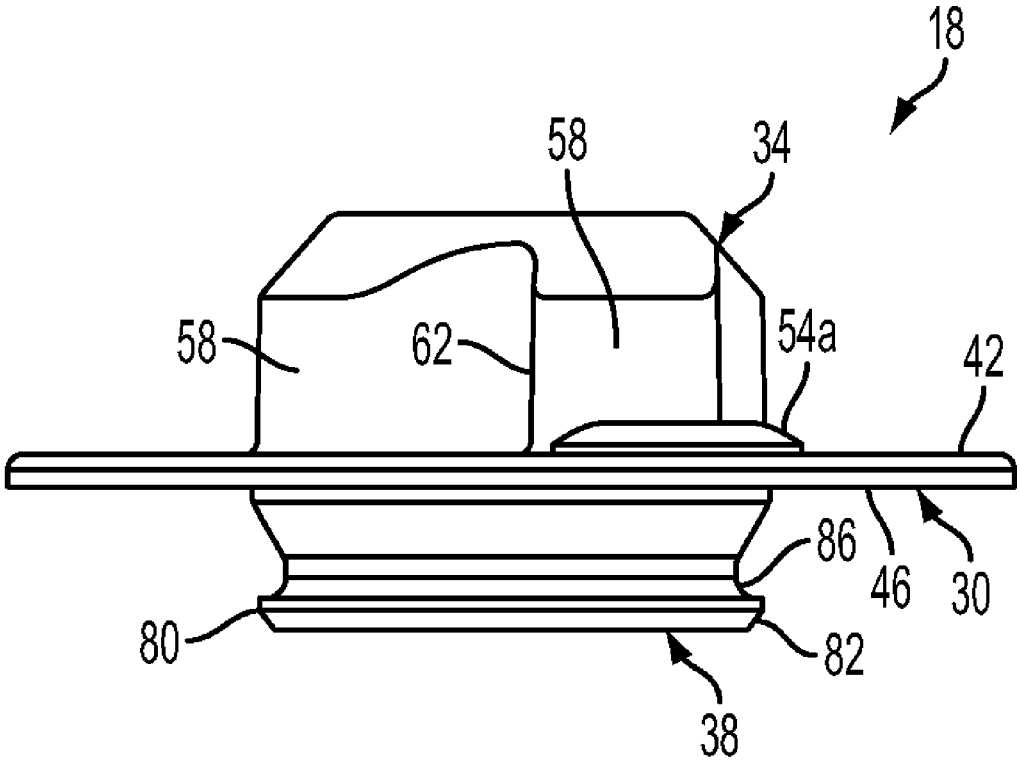
FIG. 7 is a side view of the drive member of the recoil starter system shown in FIG. 1.
Figure 8:
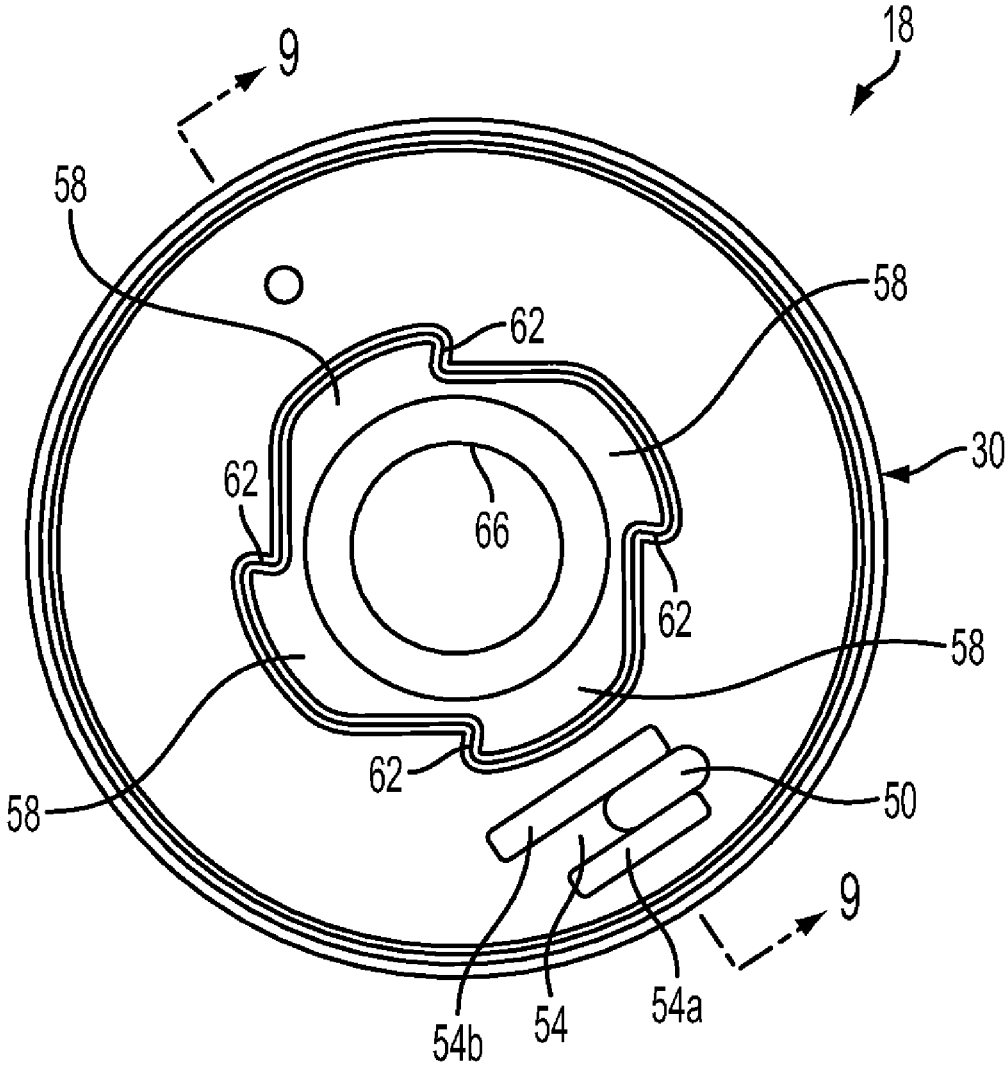
FIG. 8 is a top view of the drive member shown in FIG. 7.
Figure 9:
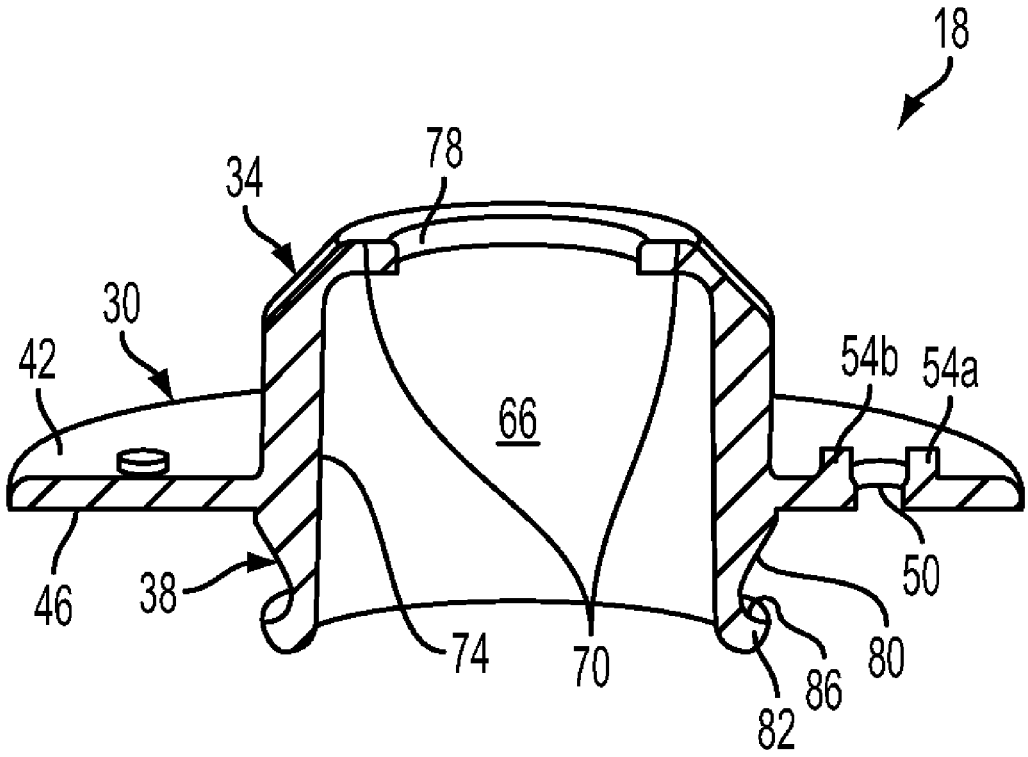
FIG. 9 is a cross-section view of the drive member taken generally along line 9-9 in FIG. 8.
Figure 10:
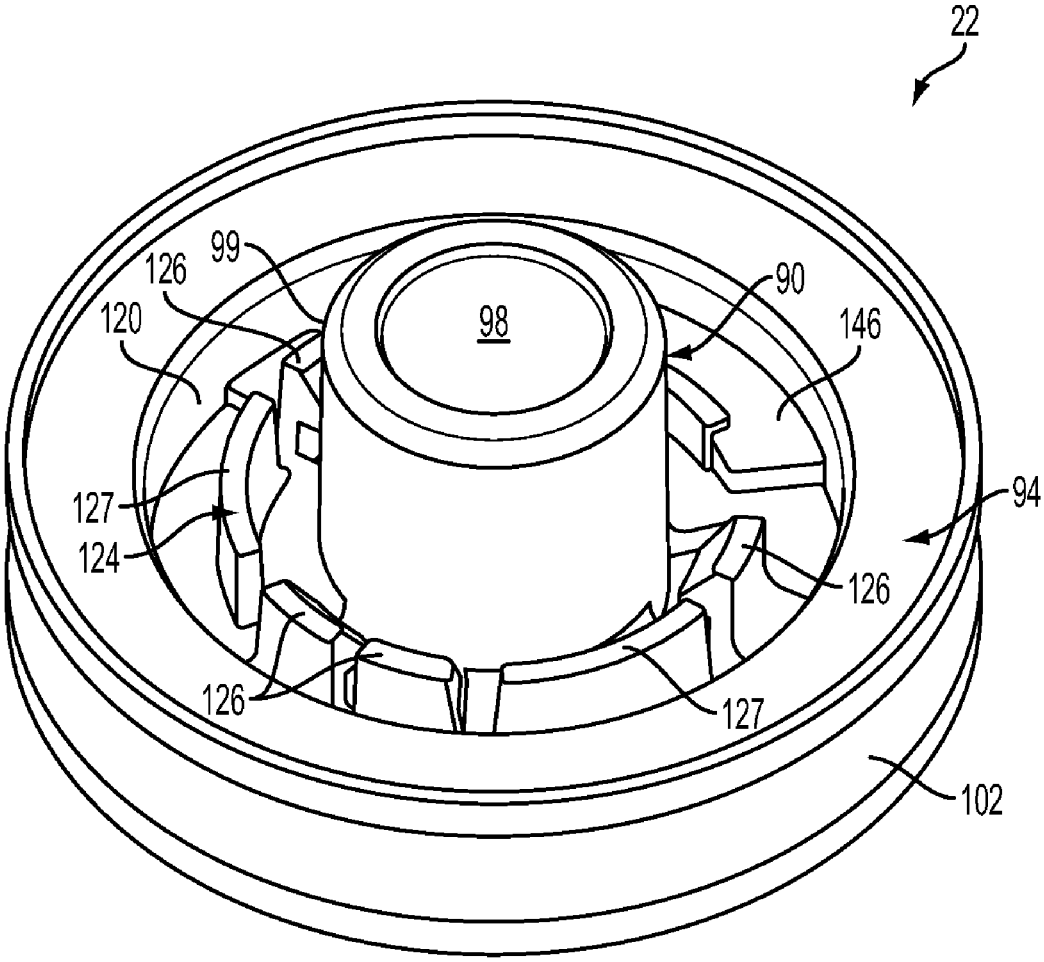
FIG. 10 is a top perspective view of a pulley member of the recoil starter system shown in FIG. 1.

As shown in FIG. 6, a rotation-limiting tab 87 may extend radially from the support portion 38 to limit the relative pivoting movement between the drive member 18 and the pulley member 22. However, the tab 87 is generally not provided such that full 360 degree rotation of the drive member 18 relative to the pulley member 22 is allowed.

In the illustrated construction, the drive member 18 is formed (e.g., by molding) as a single unitary piece of a tough, rigid material (e.g. glass filled nylon). In other constructions, the drive member 18 may be formed as two or more separate elements which are connected or fixed to provide the drive member 18.

As shown in more detail in FIGS. 5-6 and 10-14, the pulley member 22 includes a central hub 90 and a main body 94 extending radially from the central hub 90. The central hub 90 is substantially cylindrical and defines a central opening 98. The central opening 98 receives a shaft, such as a support shaft, bearing, hub, on which the pulley member 22 and the recoil starter system 14 is rotatably supported. The central hub 90 fits within the side wall 74 of the drive plate 18 with sufficient clearance to allow relative rotation between the drive plate 18 and the pulley member 22. When the drive member 18 and the pulley member 22 are connected, the end of the central hub 90 may contact, or nearly contact the top wall 70 of the drive member 18, and the opening 78 is concentric with the central opening 98. The opening 78 may also accommodate a portion of a shaft received in the central opening 98.

The main body 94 extends generally radially from the central hub 90. The main body 94 defines an outwardly-facing radial groove 102 for receiving a pull cord (not shown). The radial groove 102 is substantially "U" shaped and runs substantially the entire circumference of the main body 94. In the illustrated construction, the radial groove 102 has sufficient width and depth to support multiple windings of the pull cord. A helical ridge 104 is formed in the groove 102 to aid in proper coiling of the pull cord.

To secure the free end of the pull cord to the pulley member 22, a cord retention recess 108 (see FIG. 14) is defined by the main body 94. In the illustrated construction, the cord retention recess 108 includes a first end 112 in communication with the radial groove 102 and a second end 116 shaped to capture the free end of the pull cord and prevent its removal. In the illustrated construction, the second end 116 is a narrow groove shaped to retain a widened portion (e.g., a knot) of the pull cord. In alternate constructions, the second end 116 may include another structure to secure the free end of the pull cord, such as, for example, fasteners, coupling teeth, wedges, adhesive, welding, etc.

The main body 94 cooperates with the drive member 18 to define a cavity 120, and, in the illustrated construction (see FIGS. 10, 12 and 14), a second retainer 124 is located on the main body 94 to be within the cavity 120. The retainers 80 and 124 provide a connecting arrangement to connect the drive member 18 to the pulley member 22 while allowing relative pivoting movement between the drive member 18 and the pulley member 22. In the illustrated construction, the connecting arrangement inhibits relative axial movement of the members 18 and 22 and allows full 360 degree relative rotation of the members 18 and 22.

The second retainer 124 is configured to engage with and capture the first retainer 80. In the illustrated construction, the second retainer 124 includes a plurality of tabs 126 (four tabs 126 in the illustrated construction). In the illustrated construction (see FIGS. 11-14), openings 130 are provided at the base of each tab 126 to, for example, enable manufacture by injection molding. The tabs 126 are circumferentially spaced to, for example, distribute the retaining forces, maintain proper alignment of the members 18 and 22, etc. Equal distribution of forces between and proper alignment of the drive member 18 and the pulley member 22 may limit wear and possible binding during relative pivoting movement.

Each tab 126 is constructed to deflect radially outwardly upon initial engagement with the angled lead-in surface 82 of the first retainer 80, and the surface 82 facilitates engagement of the retainers 80 and 124. Upon further axial movement of the drive member 18 into engagement with the pulley member 22, each tab 126 returns to its retaining position so that the tabs 126 engage the retaining surface 86 of the drive member 18 such that the drive member 18 is axially connected to the pulley member 22. With such a connection, the drive member 18 is pivotable relative to the pulley member 22. In the illustrated construction, the recoil starter system 14 may thus be substantially connected as a unit without separate fastening structure.

In alternate constructions (not shown), the second retainer 124 may include another configuration to provide a connection between the drive member 18 and the pulley member 22. For example, the second retainer 124 may be formed as one or more ridges extending about the circumference of the central hub 90, and, in such a construction, the first retainer 80 may include a number of relatively narrow retaining tabs.

Other connecting arrangements, such as, for example, a bayonet engagement, may be provided between the retainers 80 and 124. In such an arrangement, the retainers 80 and 124 may be engageable in one rotational position (an engagement position) and rotated to another rotational position in which disengagement is prevented. The engagement position would be rotationally beyond the range of operating positions such that the retainers 80 and 124 are not disengaged during operation.

Figure 12:
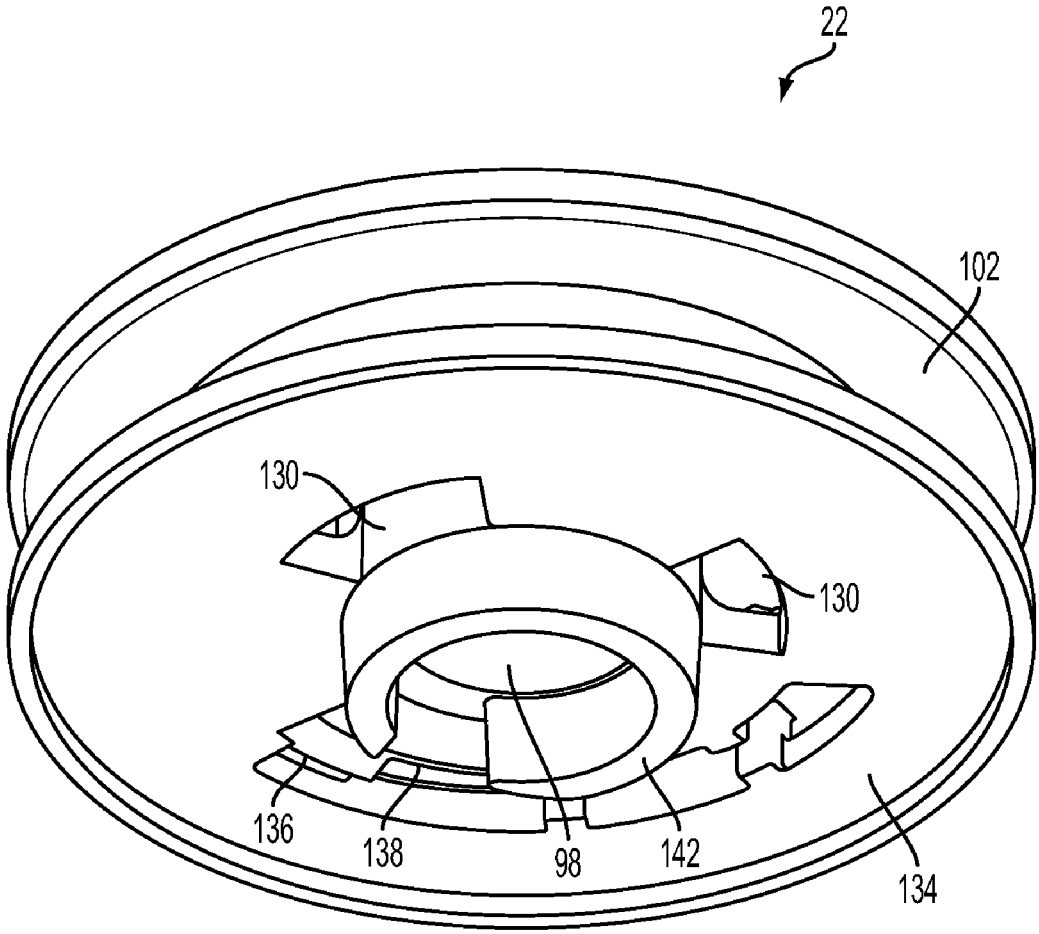
FIG. 12 is a bottom perspective view of the pulley member shown in FIG. 10.
Figure 13:
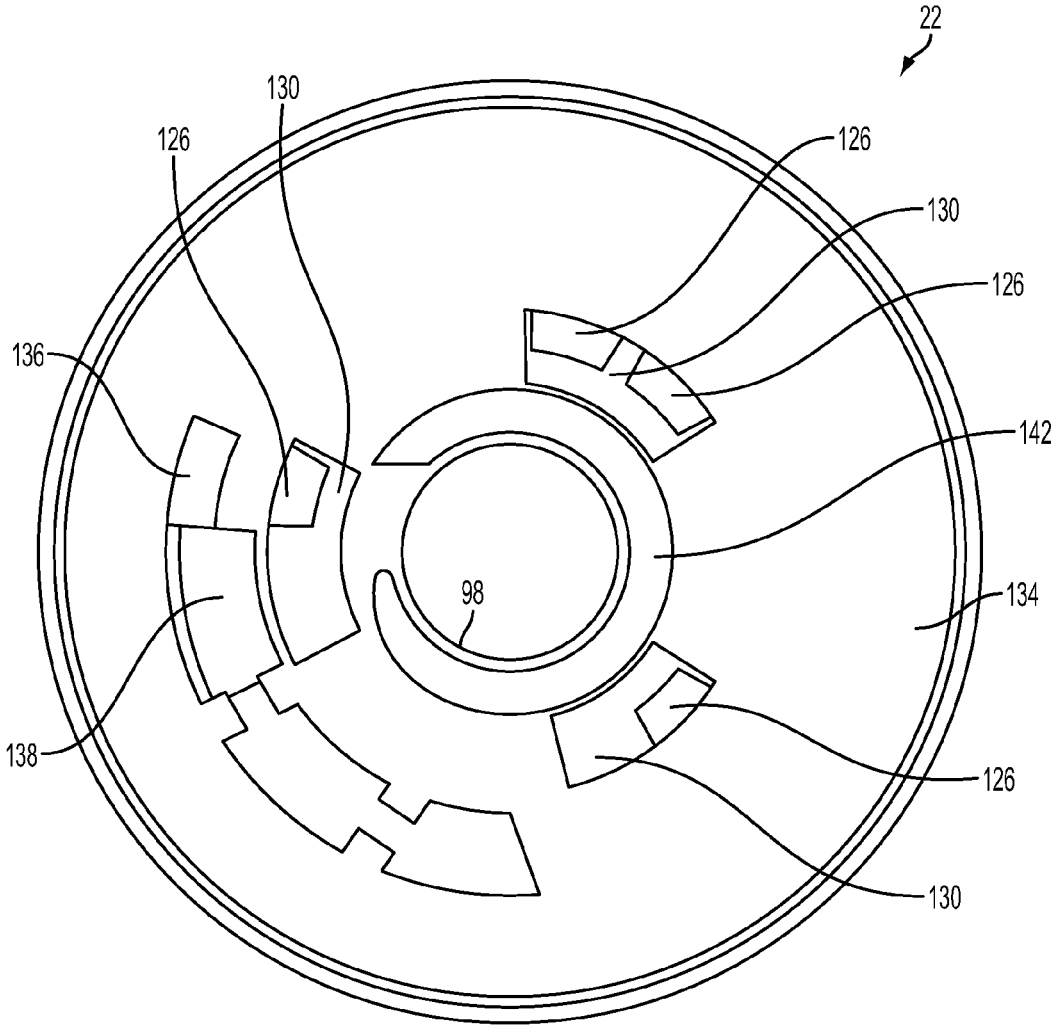
FIG. 13 is a bottom view of the pulley member shown in FIG. 10.

As shown in FIGS. 12 and 13, a second slot 136 is provided on a bottom surface 134 of the main body 94. The slot 136 is configured to receive and retain a portion of the spring member 26 (as described below). In the illustrated construction, the slot 136 is recessed into the bottom surface 134 and extends generally tangentially. The slot 136 is generally adjacent and in communication with a recess 138 which opens into the cavity 120.

In the illustrated construction, the slot 136 is bordered on three sides. In alternative constructions, the slot 136 may be formed by a plurality of ridges (similar to the ridges **54*a* and 54*b* for the first slot 54**) or as a covered slot and/or may extend in another direction (e.g., radially).

Figure 11:
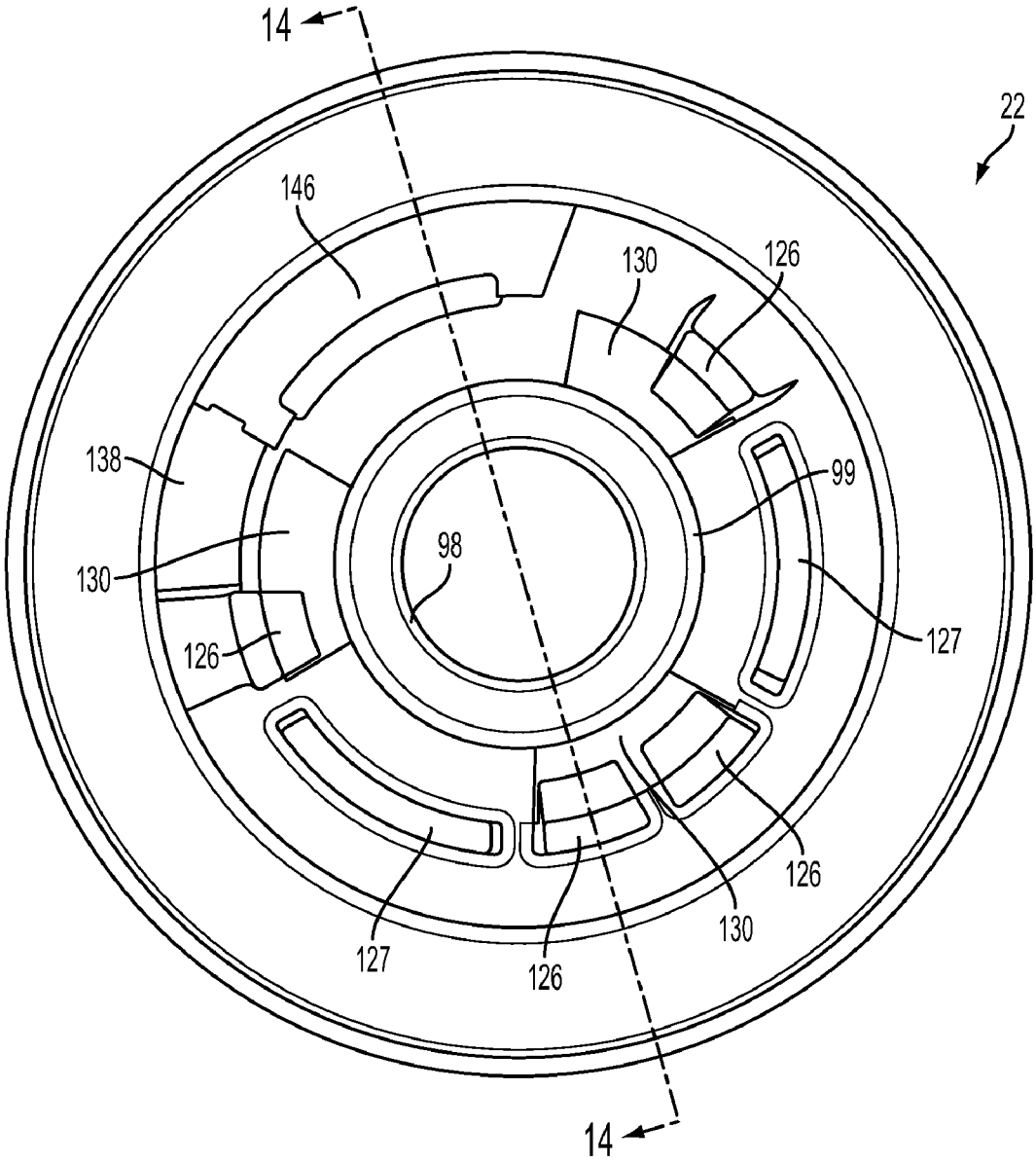
FIG. 11 is a top view of the pulley member shown in FIG. 10.
Figure 14:
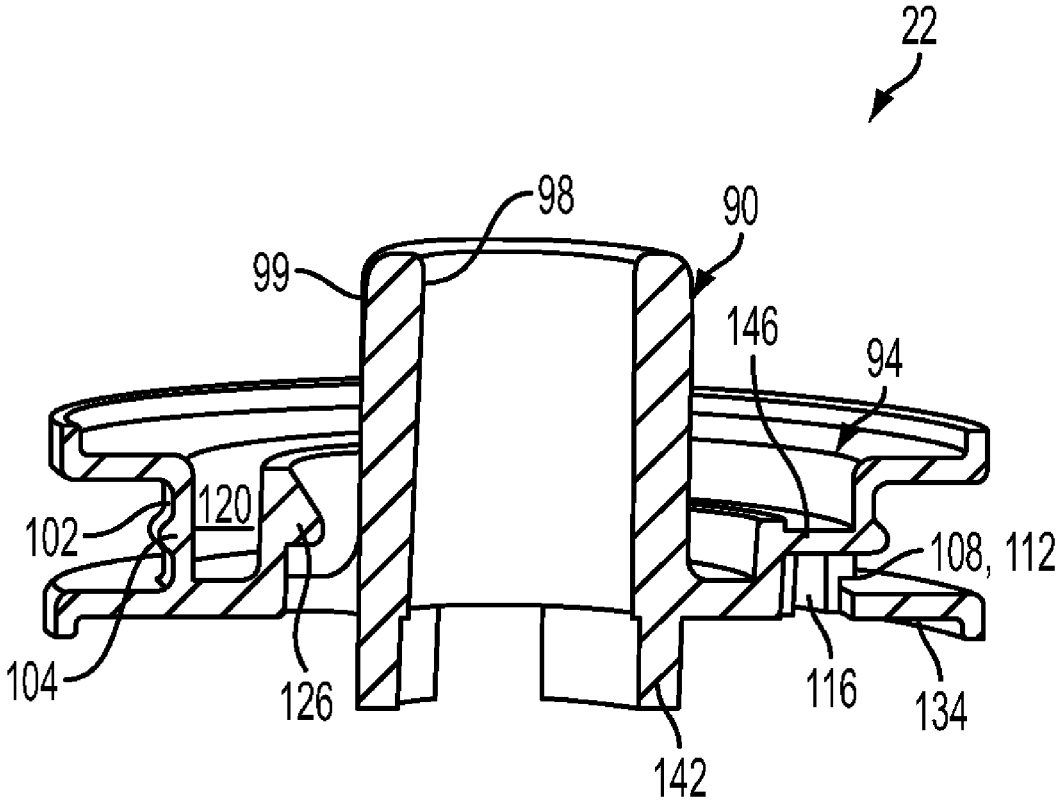
FIG. 14 is a cross-section view of the pulley member taken generally along line 14-14 in FIG. 11.

As shown in FIGS. 11 and 13-14, a recoil spring retainer 142 extends axially from the bottom surface 134 of the main body 94. The recoil spring retainer 142 receives one end of a recoil spring (not shown), and the other end of the recoil spring is connected to adjacent fixed structure (e.g., the housing (not shown)). The recoil spring operates to rotate the pulley member 22 and the recoil starter system 14 in the direction opposite to the pulling direction and to wind the pull cord within the radial groove 102.

As shown in FIGS. 10, 12, 14 and 18-19, a spring support 146 is provided in the cavity 120. The spring support 146 extends a portion of the circumference of the pulley member 22 and forms a substantially wedge shape. The wedge begins near the recess 138 and extends gradually into the cavity 120. The spring support 146 provides stability to the spring member 26, preventing the spring member 26 from tilting relative to the axis A, and limits spring distortion when the spring member 26 is acted upon by a force.

In the illustrated construction, the pulley member 22 is formed (e.g., by molding) as a single unitary piece of a tough, rigid material (e.g. glass filled nylon). In other constructions, the pulley member 22 may be formed as two or more separate elements which are connected or fixed to provide the pulley member 22.

In the illustrated construction, the drive member 18 and the pulley member 22 are formed of the same material. In other constructions, the members 18 and 22 may be formed of different materials (e.g., the drive member 18 may be formed of a more durable material).

Figure 5:
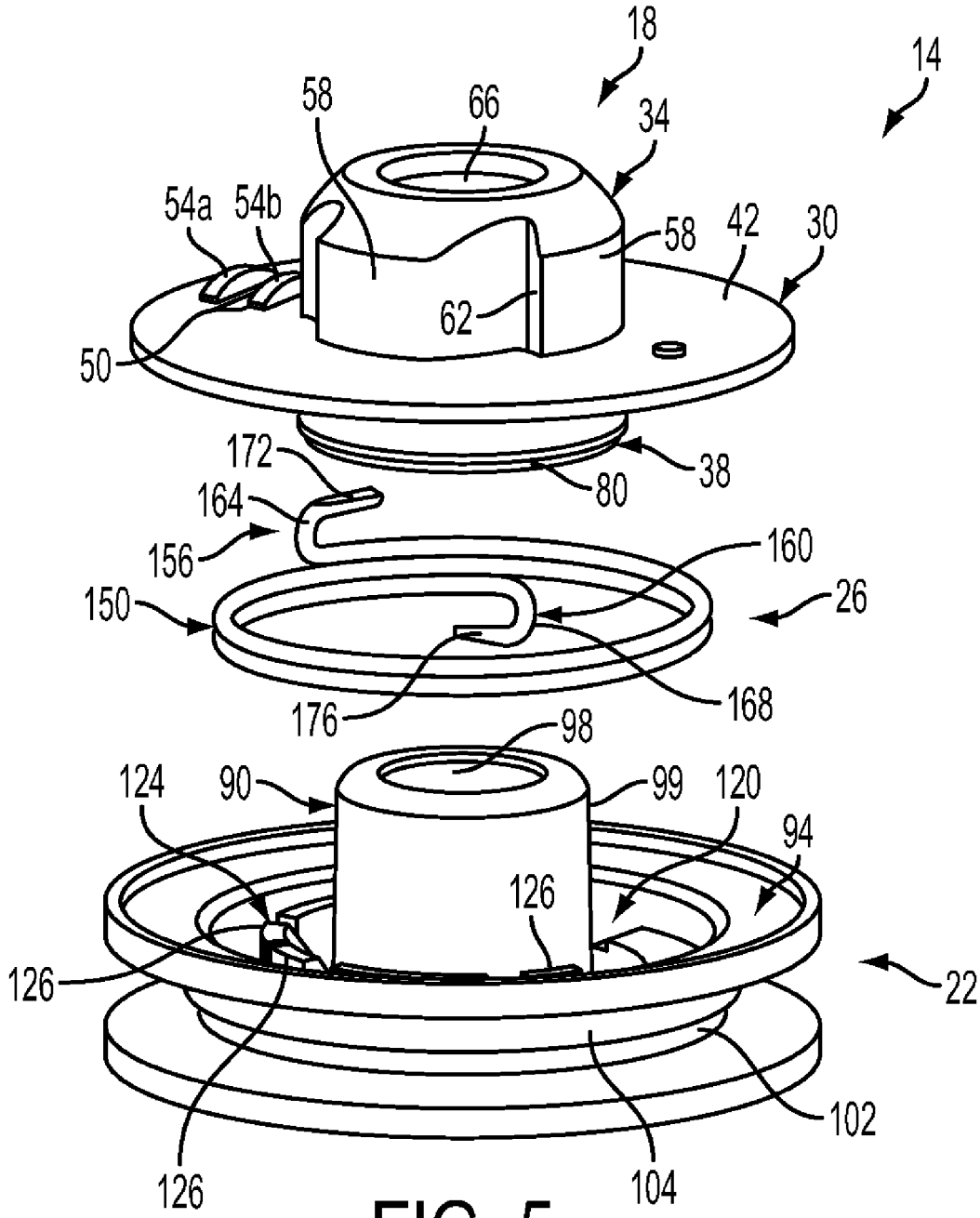
FIG. 5 is an exploded top view of the recoil starter system shown in FIG. 1.
Figure 15:
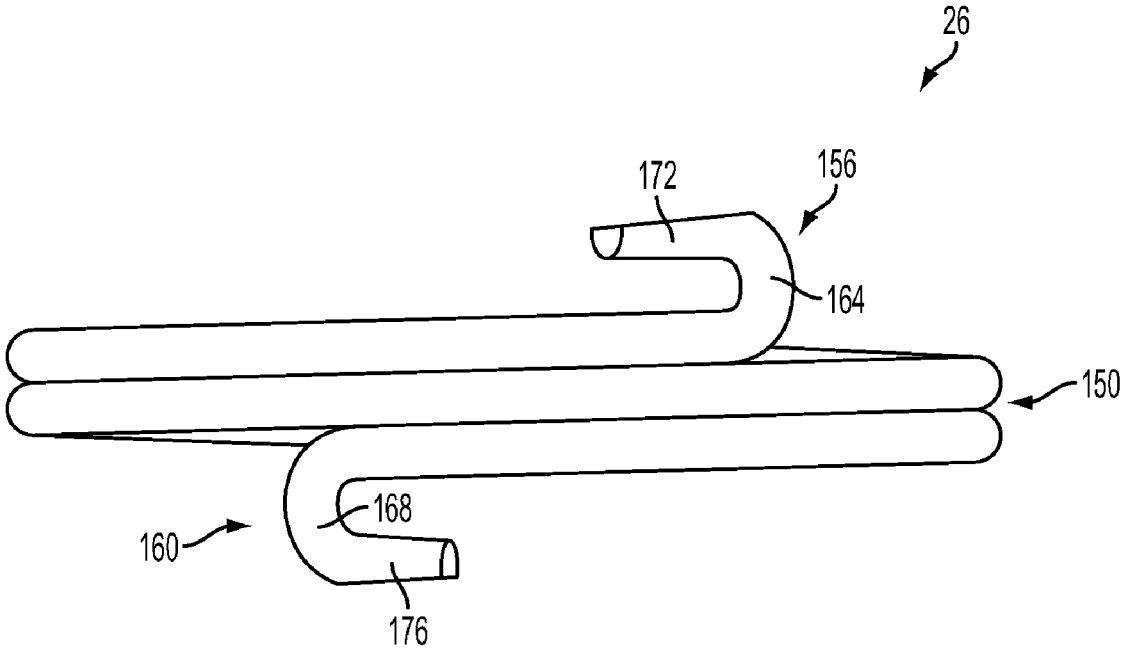
FIG. 15 is a side view of a spring member of the recoil starter system shown in FIG. 1.
Figure 16:
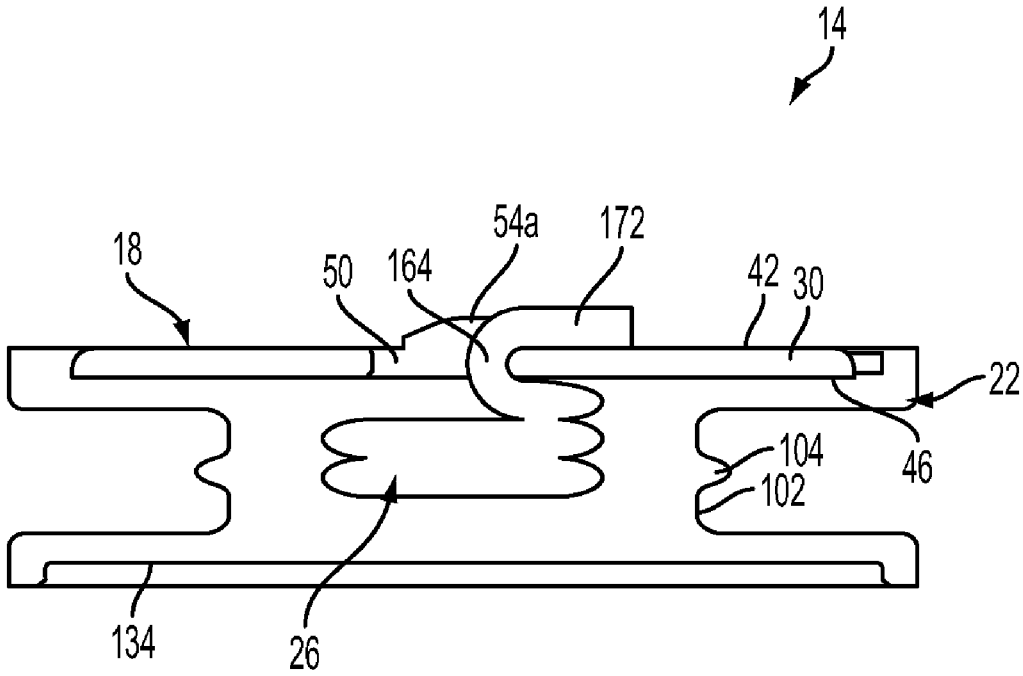
FIG. 16 is a cross-sectional view taken of the recoil starter system generally along line 16-16 in FIG. 3.
Figure 17:
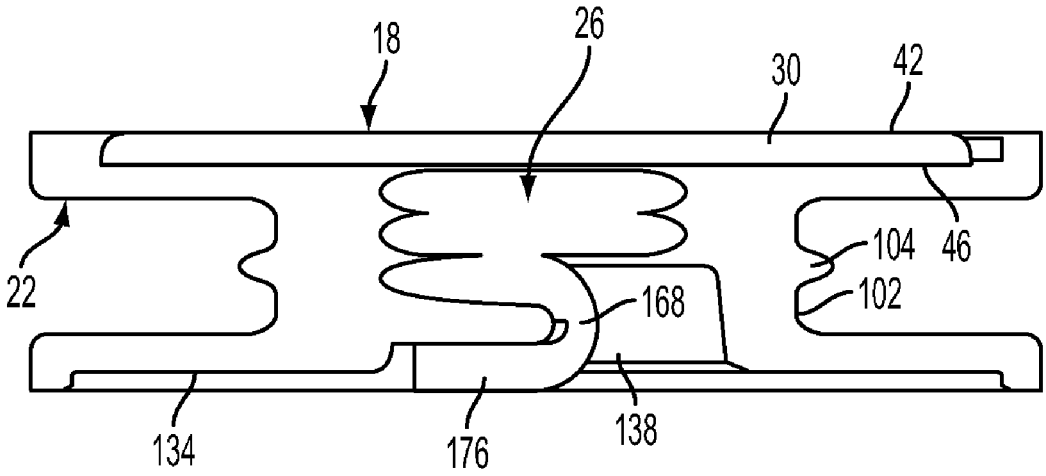
FIG. 17 is a cross-sectional view taken of the recoil starter system generally along line 17-17 in FIG. 4.

As shown more clearly in FIGS. 5-6 and 15, the spring member 26 includes a generally helical body portion 150, a first end 156, and a second end 160. The opposite ends 156, 160 are substantially hook shaped. Each end 156, 160 respectively includes an axially extending leg 164, 168 and an engaging portion 172, 176 which is chamfered.

Figure 2:
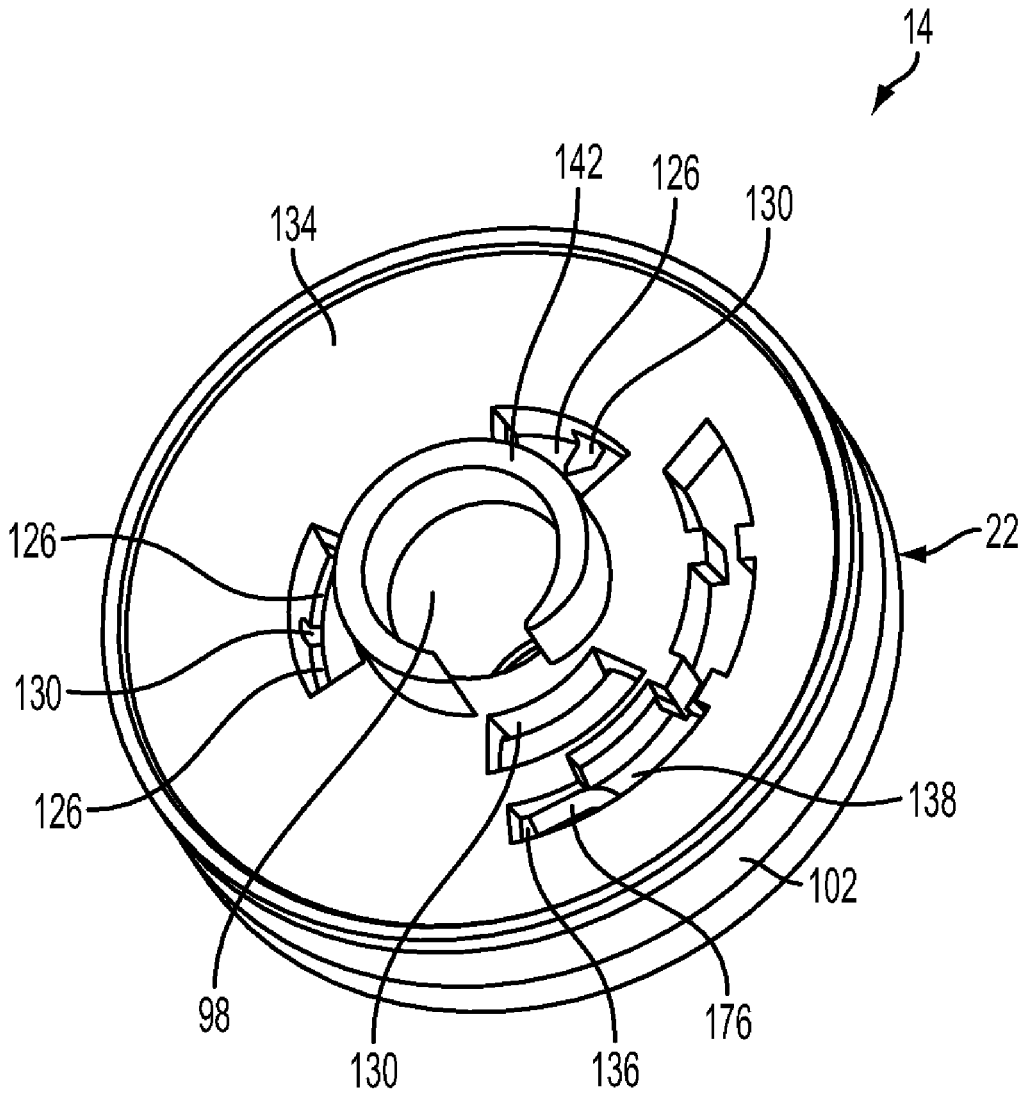
FIG. 2 is a bottom perspective view of the recoil starter system shown in FIG. 1.
Figure 3:
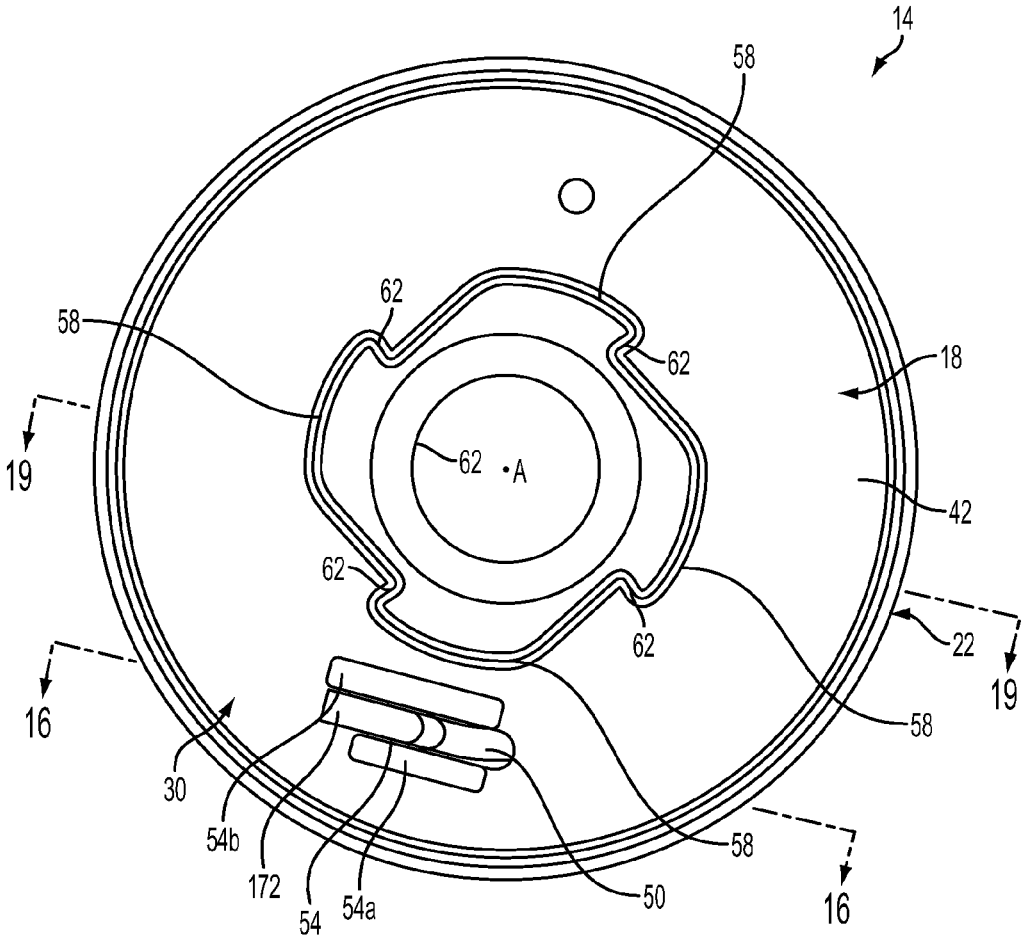
FIG. 3 is a top view of the recoil starter system shown in FIG. 1.
Figure 4:
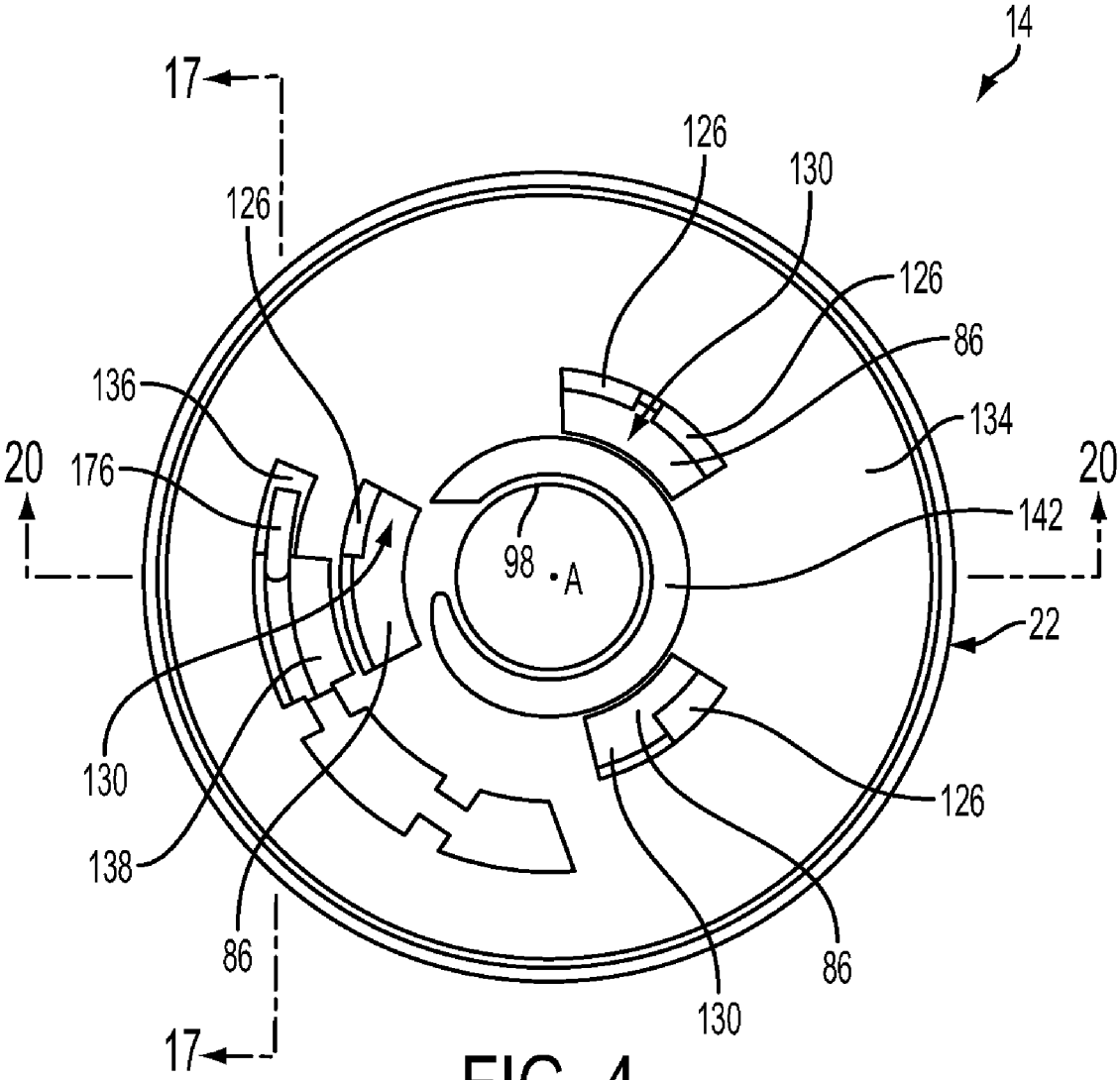
FIG. 4 is a bottom view of the recoil starter system shown in FIG. 1.
Figure 18:
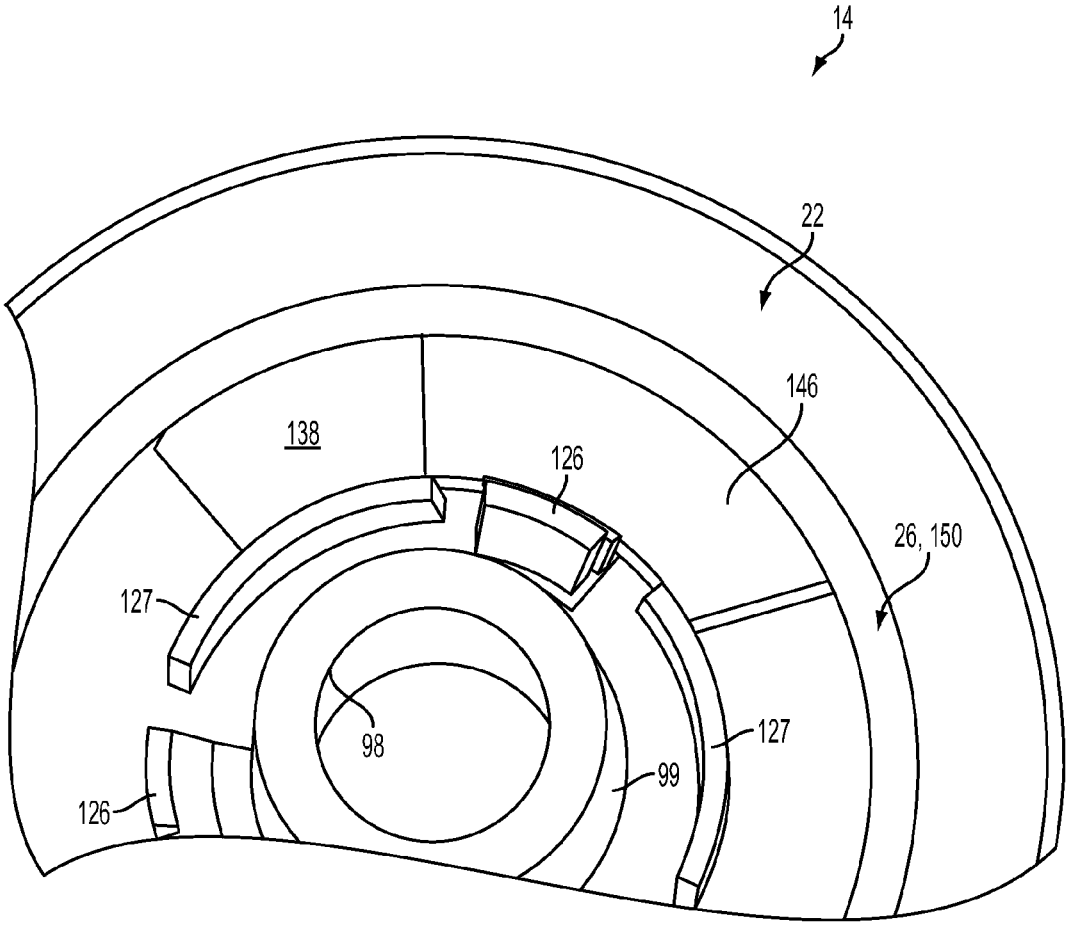
FIG. 18 is an enlarged top perspective view of the pulley member and the spring member shown in FIG. 1.
Figure 19:
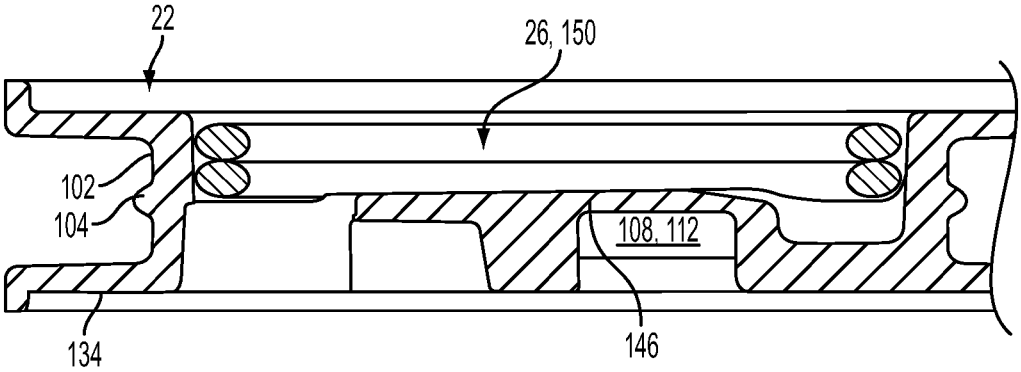
FIG. 19 is a cross-sectional view taken generally of the recoil starter system along line 19-19 in FIG. 3 with the drive member removed for clarity.
Figure 20:
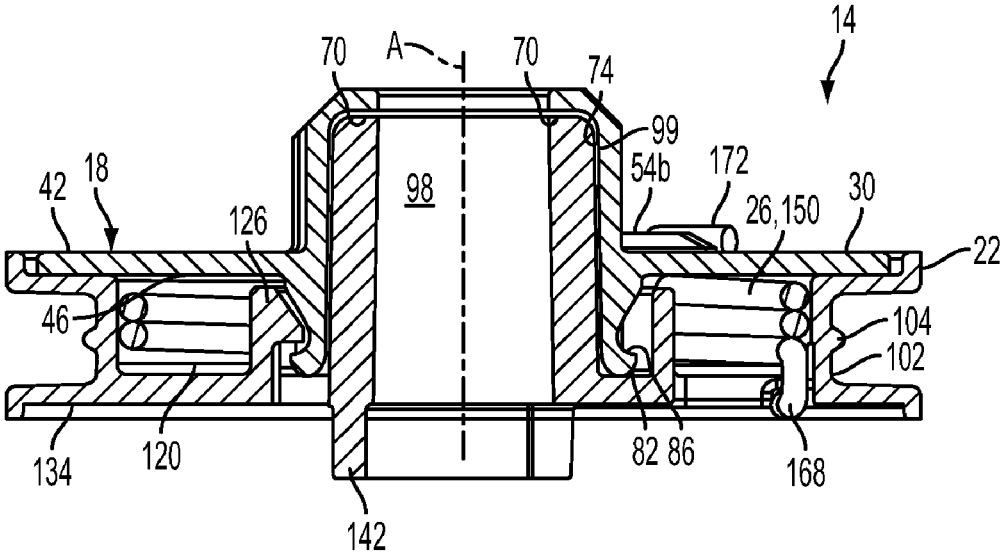
FIG. 20 is a cross-sectional view taken generally along line 20-20 in FIG. 4.
Figure 21:
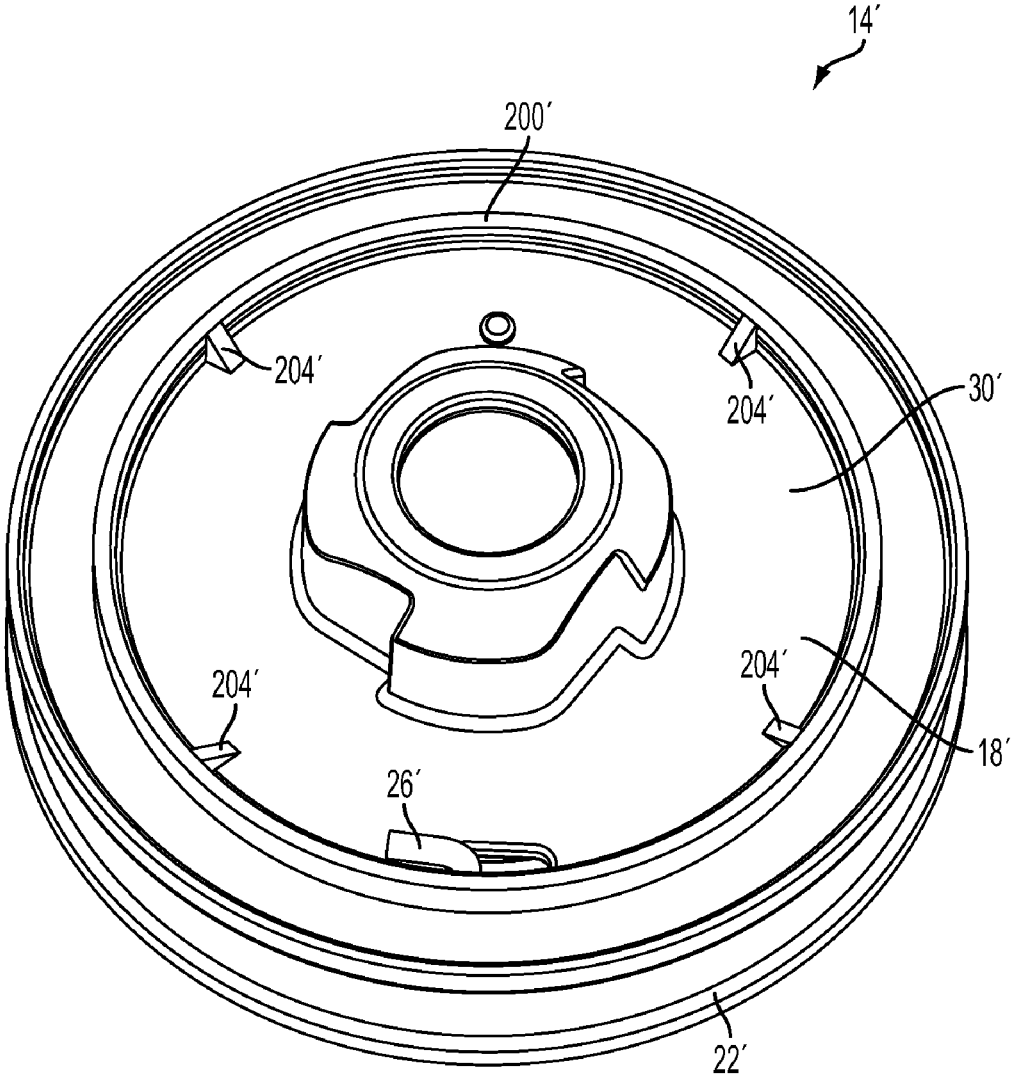
FIG. 21 is a top perspective view of an alternative construction of the recoil starter system.
Figure 22:
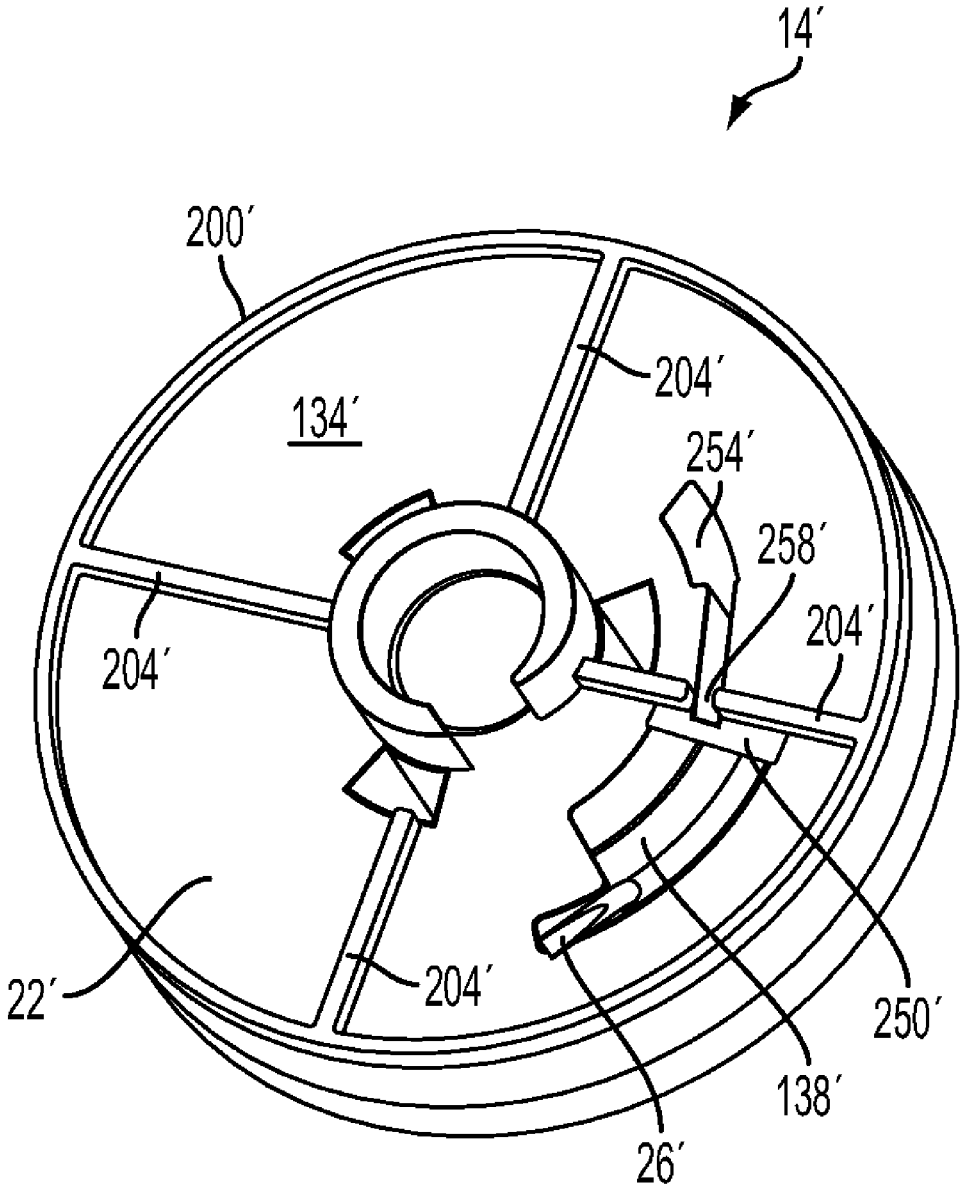
FIG. 22 is a bottom perspective view of the recoil starter system shown in FIG. 21.
Figure 23:
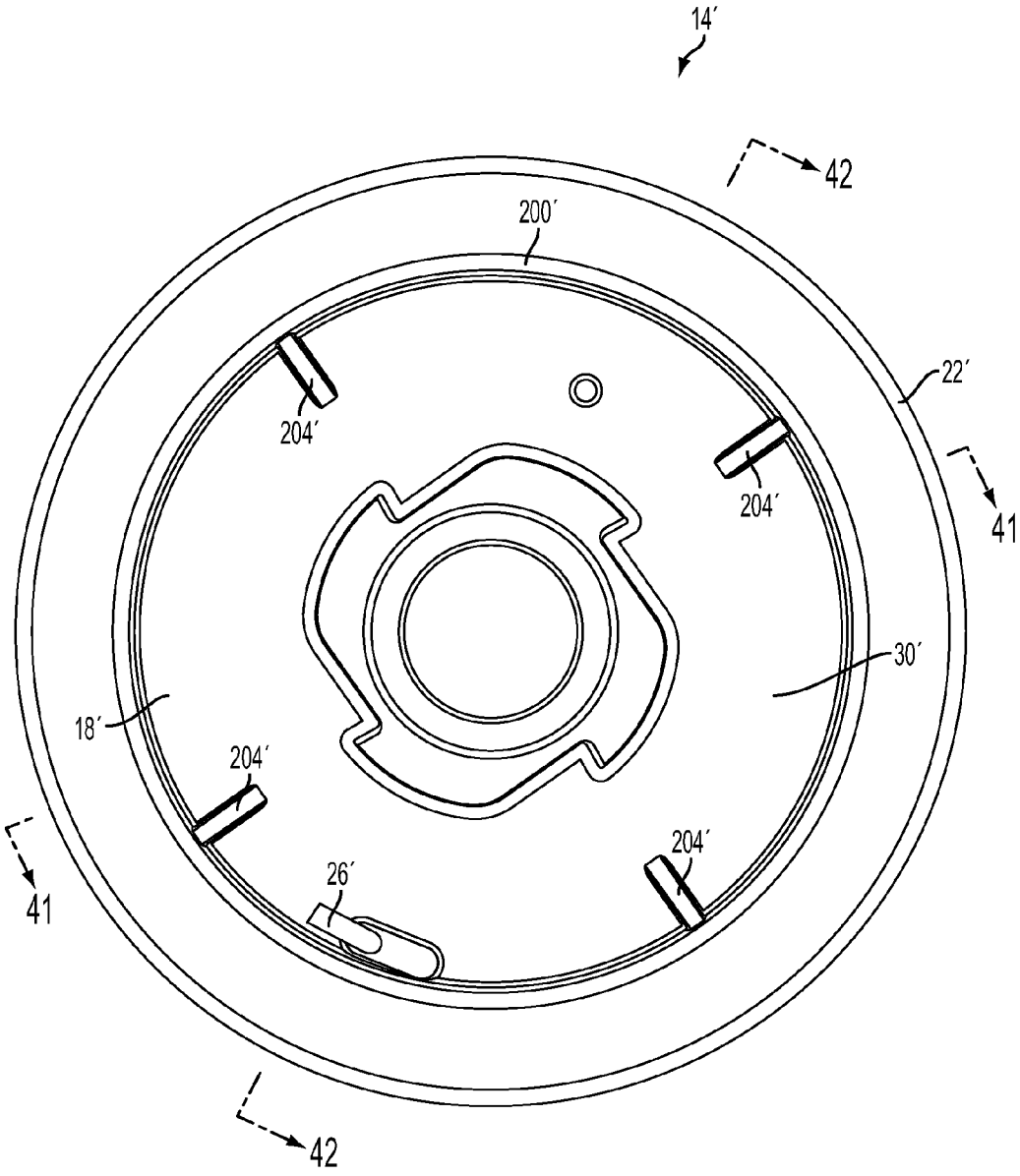
FIG. 23 is a top view of the recoil starter system shown in FIG. 21.
Figure 24:
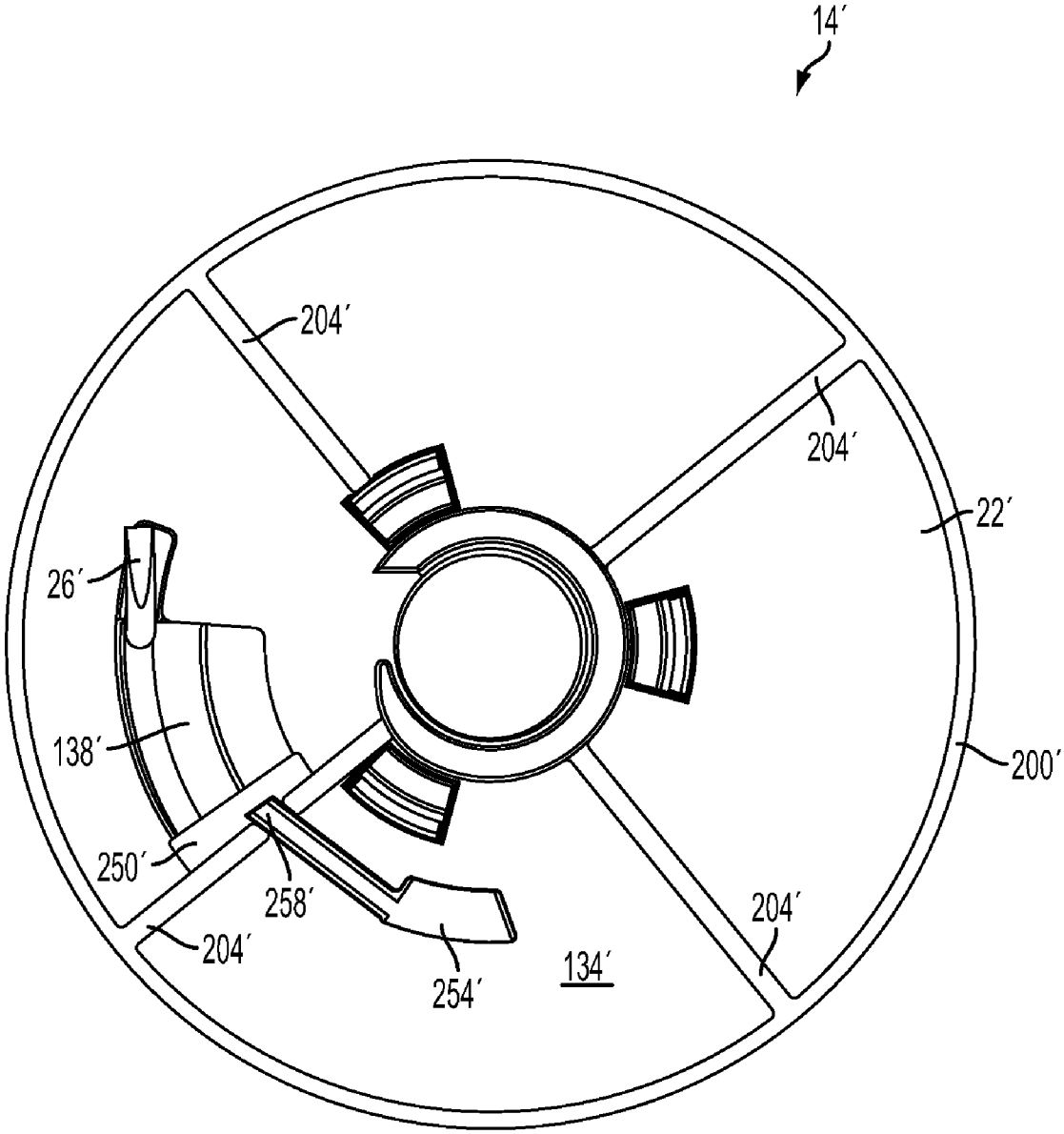
FIG. 24 is a bottom view of the recoil starter system shown in FIG. 21.
Figure 25:
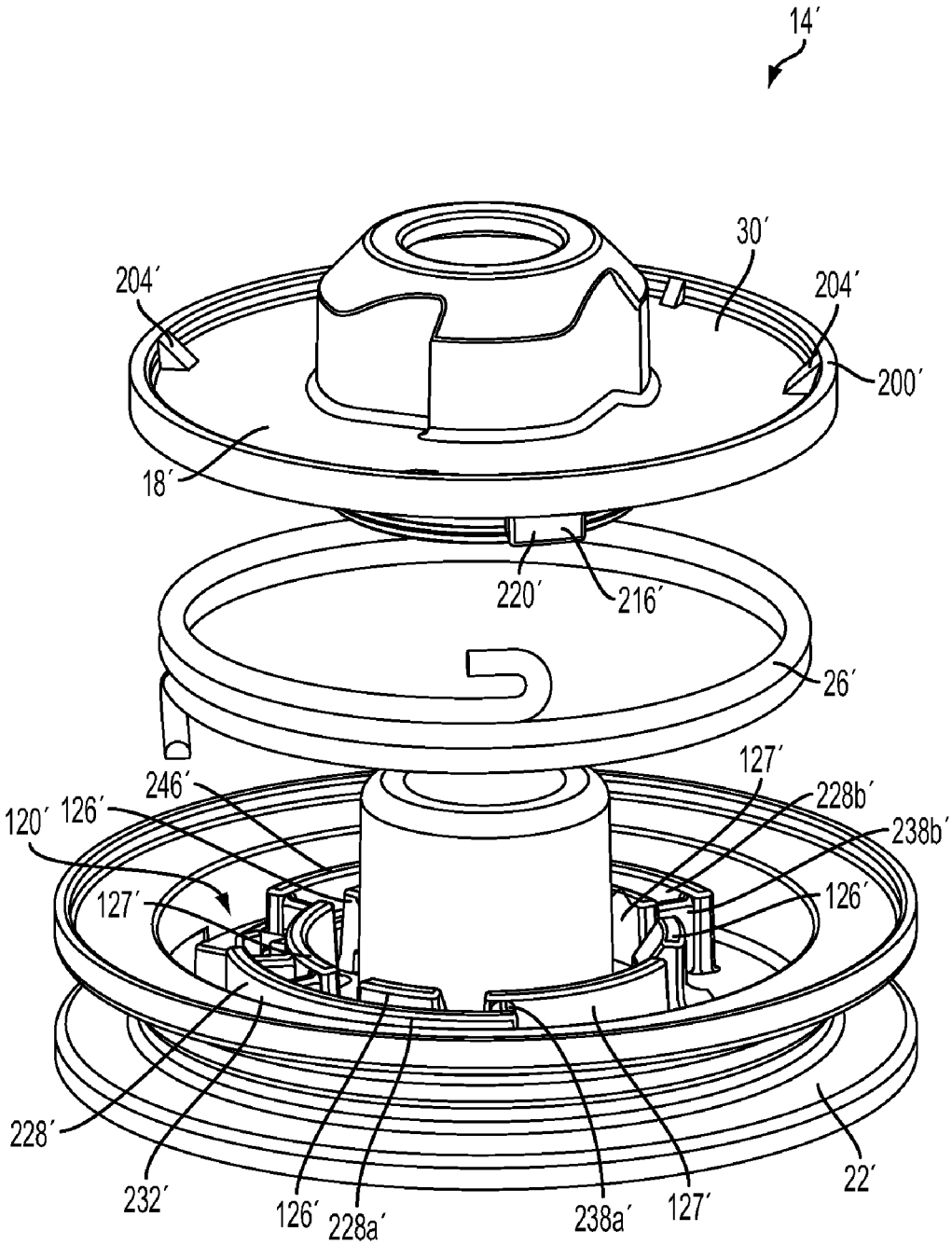
FIG. 25 is an exploded top view of the recoil starter system shown in FIG. 21.
Figure 26:
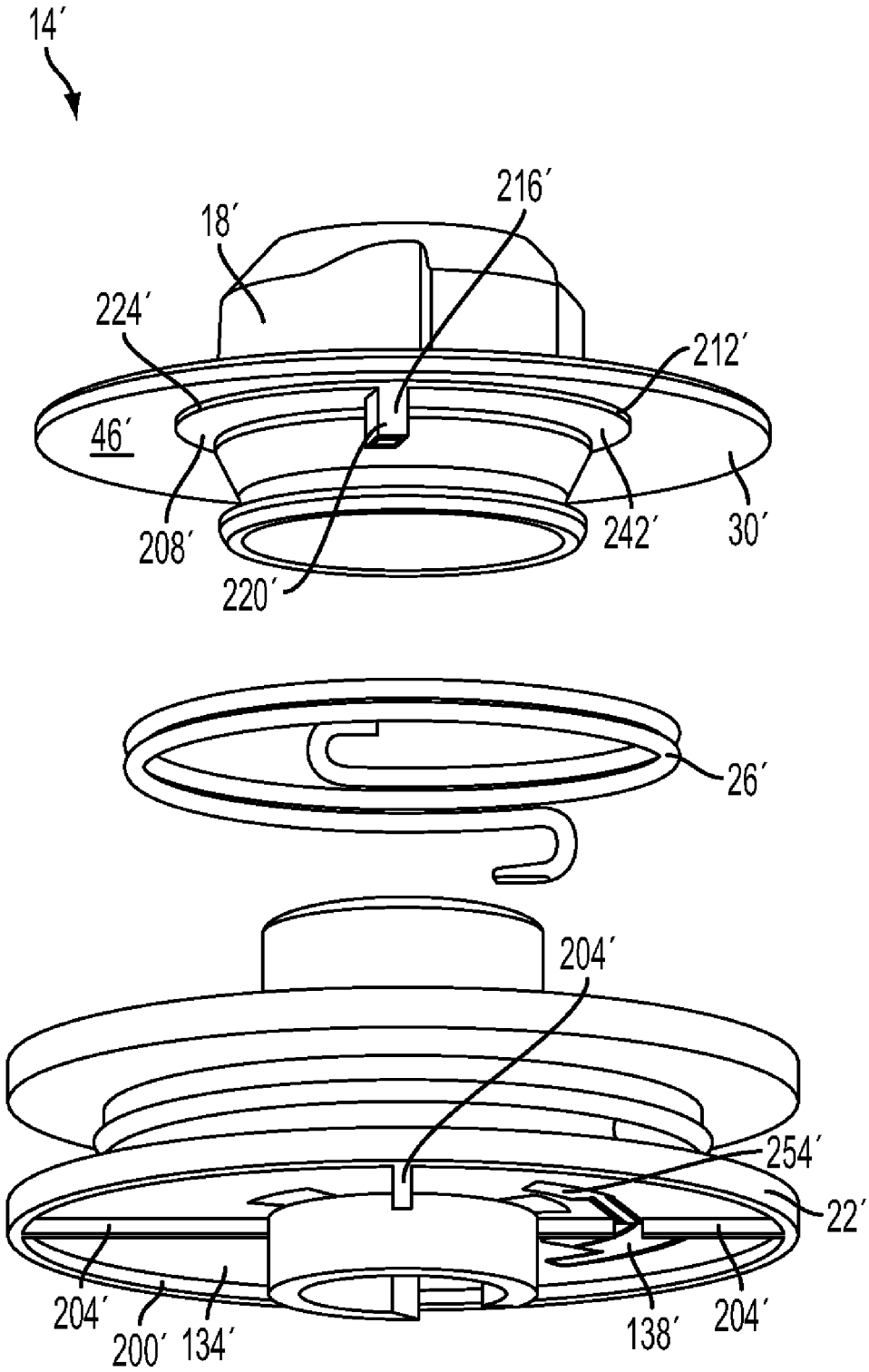
FIG. 26 is an exploded bottom view of the recoil starter system shown FIG. 21.
Figure 27:
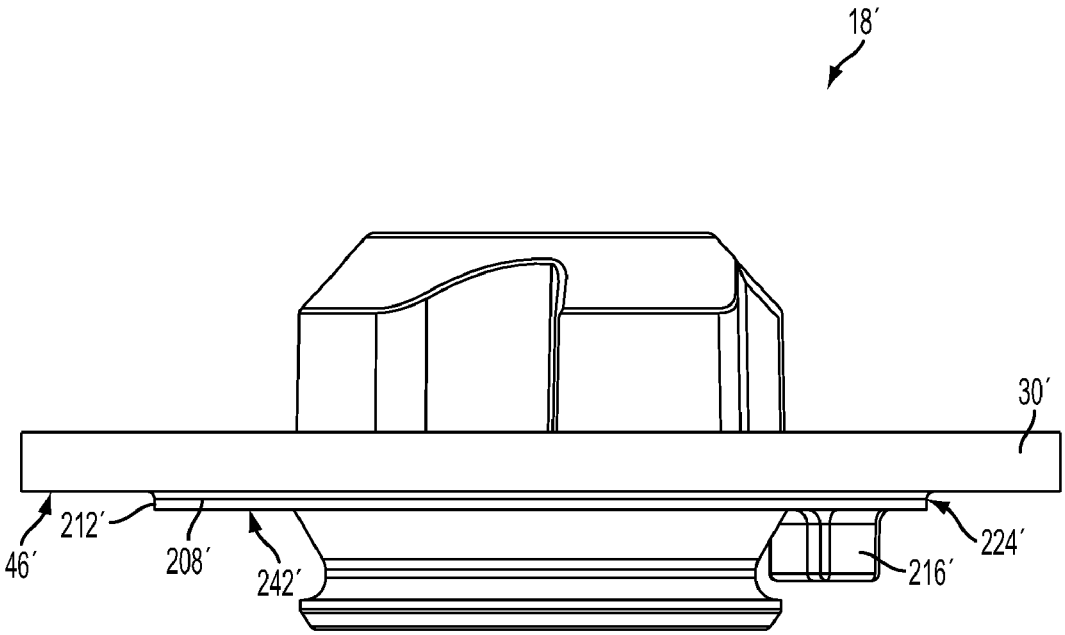
FIG. 27 is a side view of the drive member of the recoil starter system shown in FIG. 21.
Figure 28:
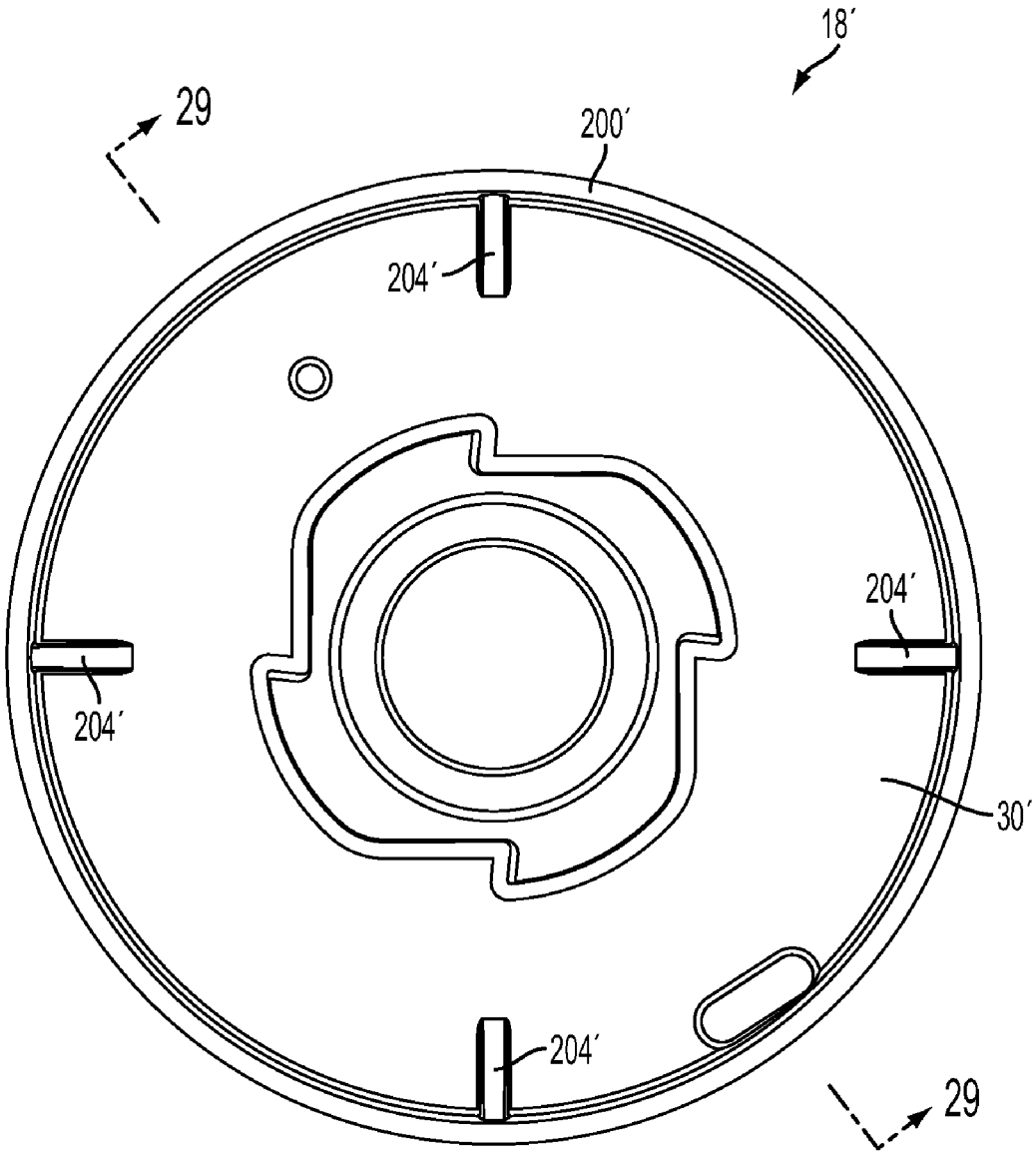
FIG. 28 is a top view of the drive member shown in FIG. 27.
Figure 29:
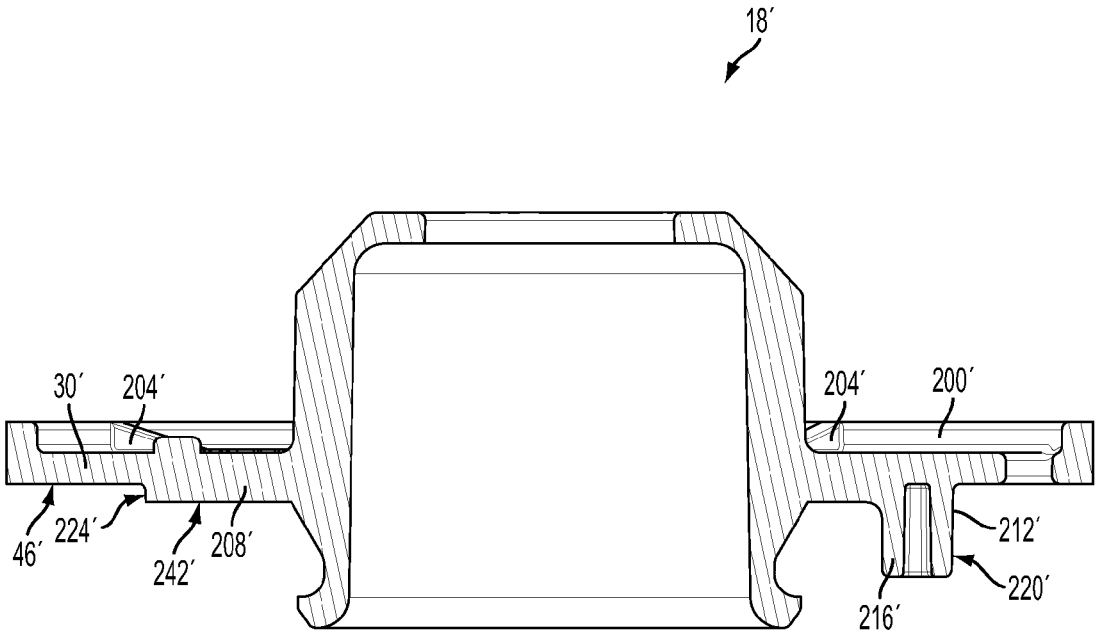
FIG. 29 is a cross-section view of the drive member taken generally along line 29-29 in FIG. 28.
Figure 30:
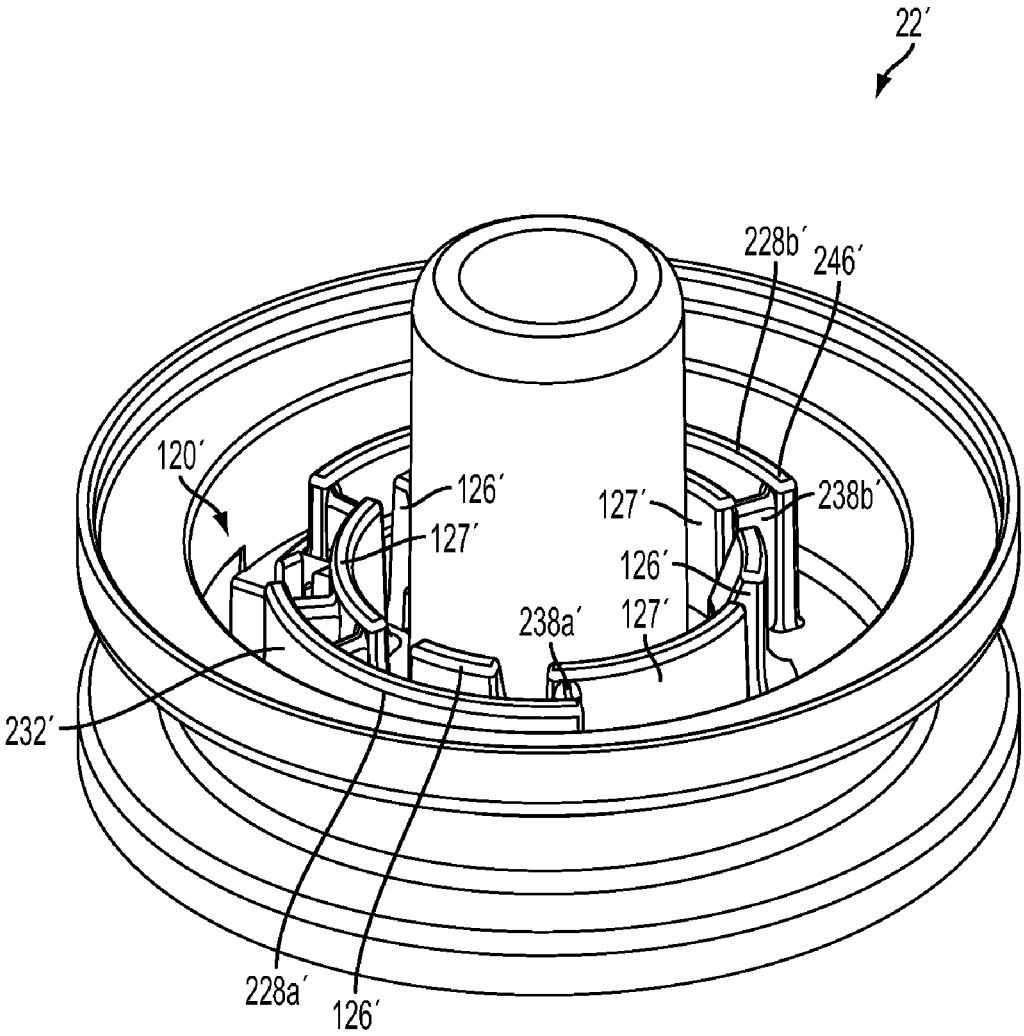
FIG. 30 is a top perspective view of a pulley member of the recoil starter system shown in FIG. 21.
Figure 31:
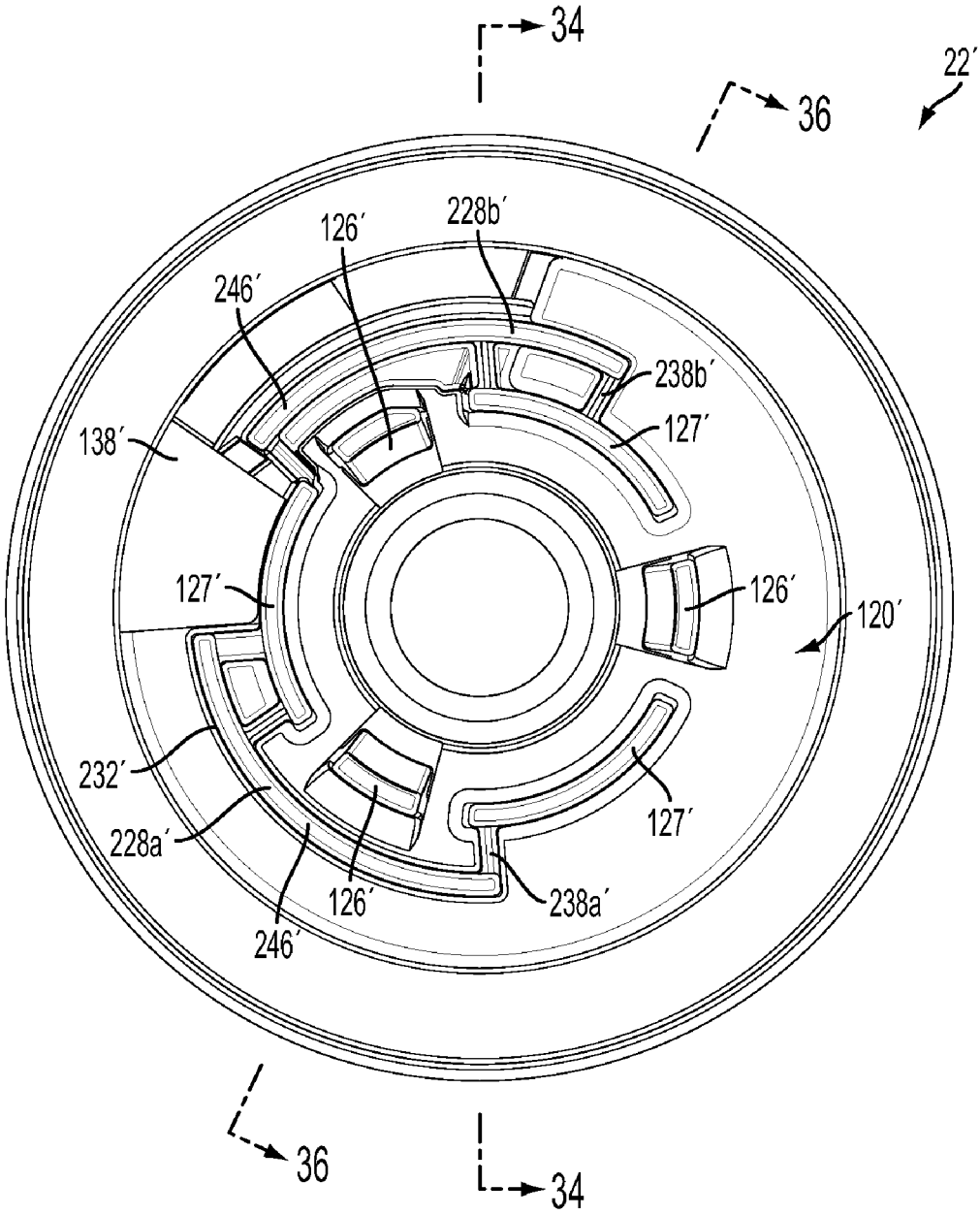
FIG. 31 is a top view of the pulley member shown in FIG. 30.
Figure 32:
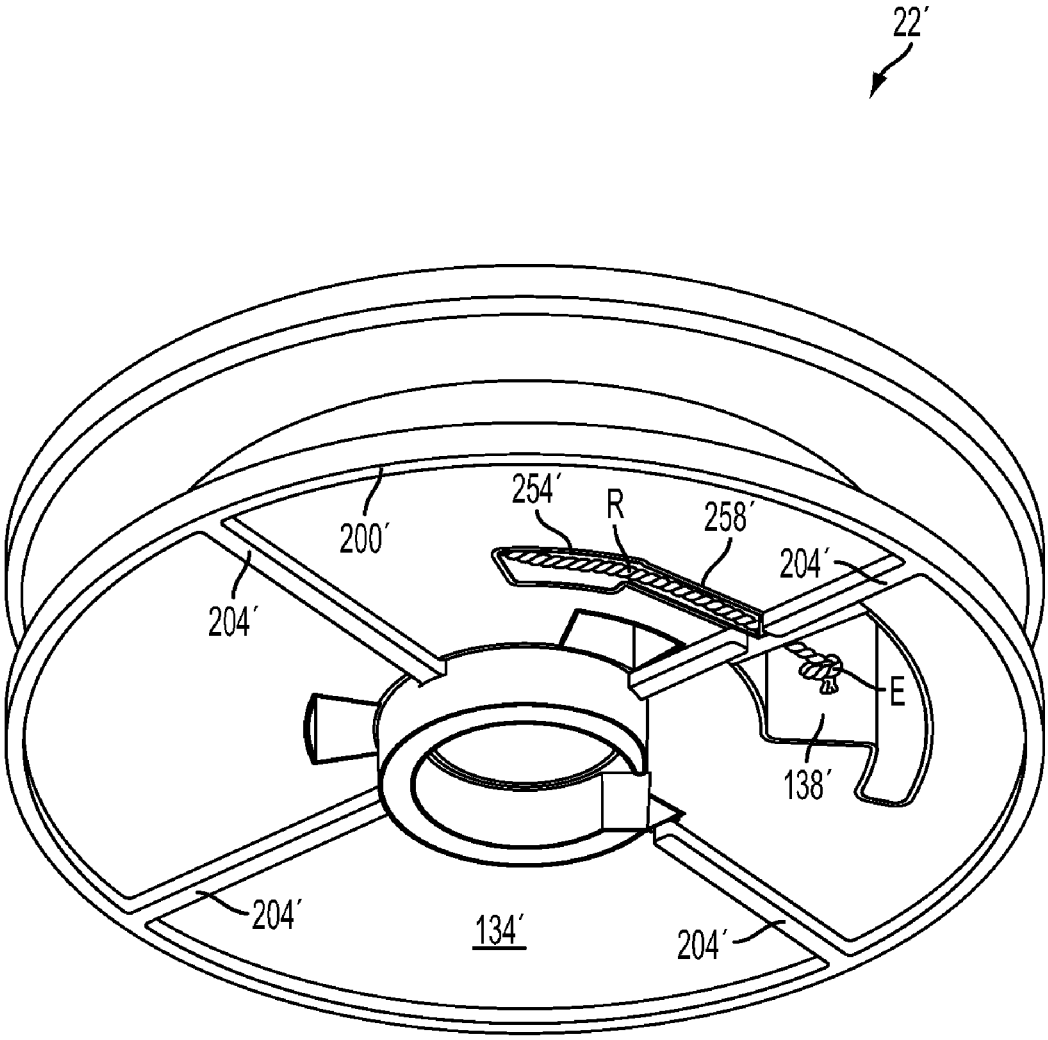
FIG. 32 is a bottom perspective view of the pulley member shown in FIG. 30.
Figure 33:
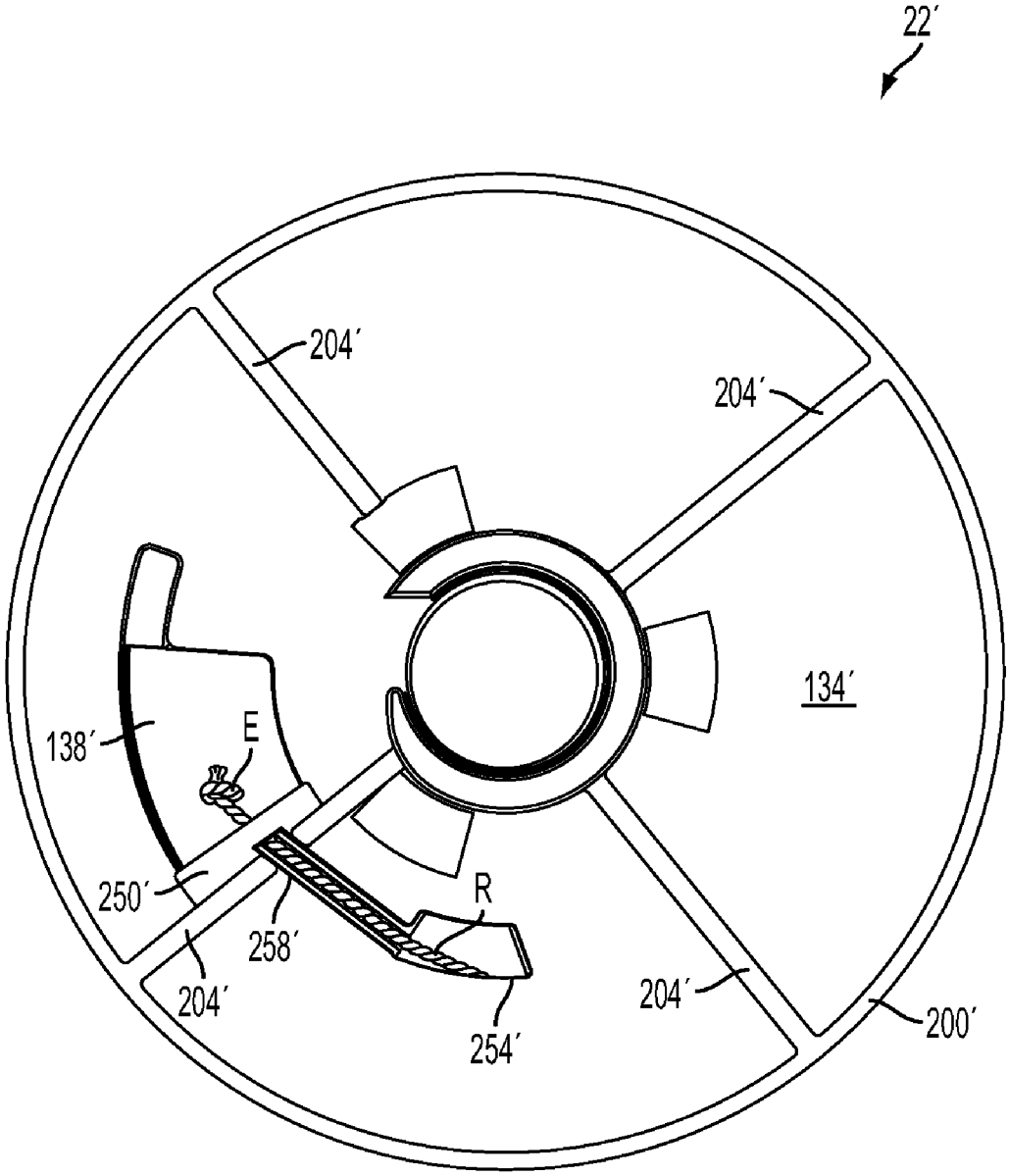
FIG. 33 is a bottom view of the pulley member shown in FIG. 30.
Figure 34:
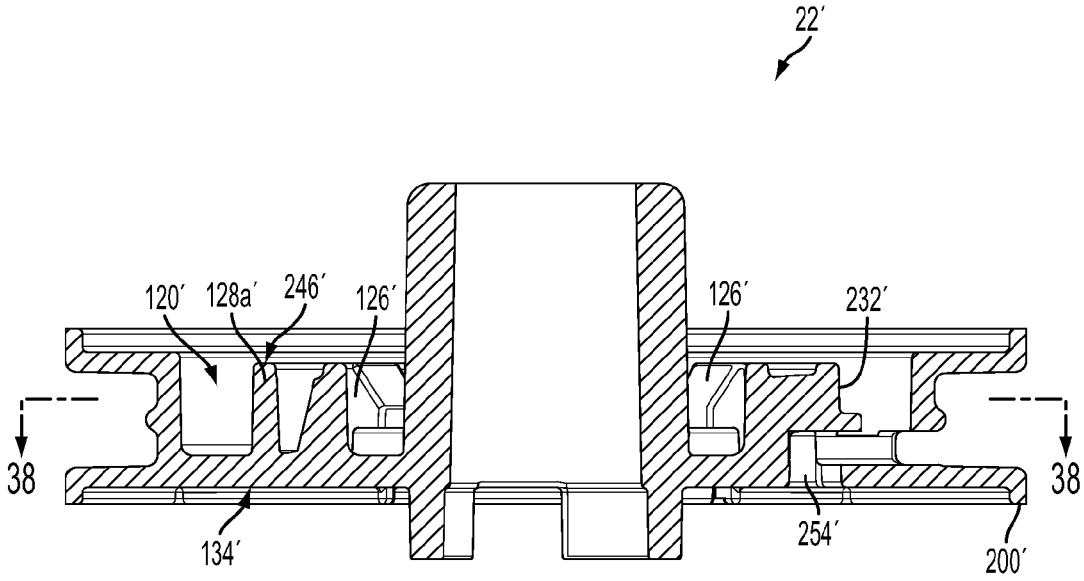
FIG. 34 is a cross-section view of the pulley member taken generally along line 34-34 in FIG. 31.
Figure 35:
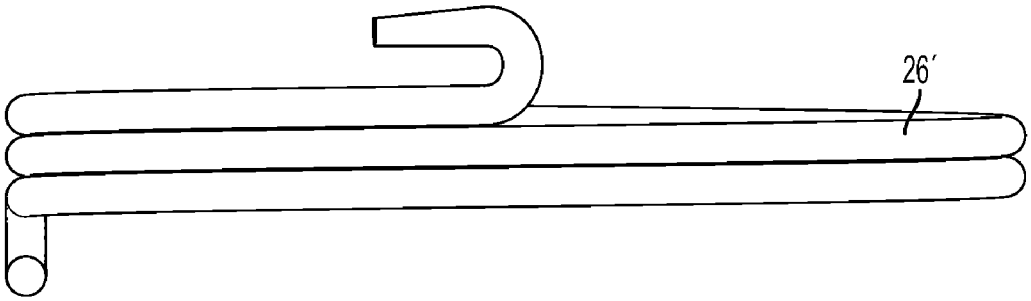
FIG. 35 is a side view of a spring member of the recoil starter system shown in FIG. 21.
Figure 36:
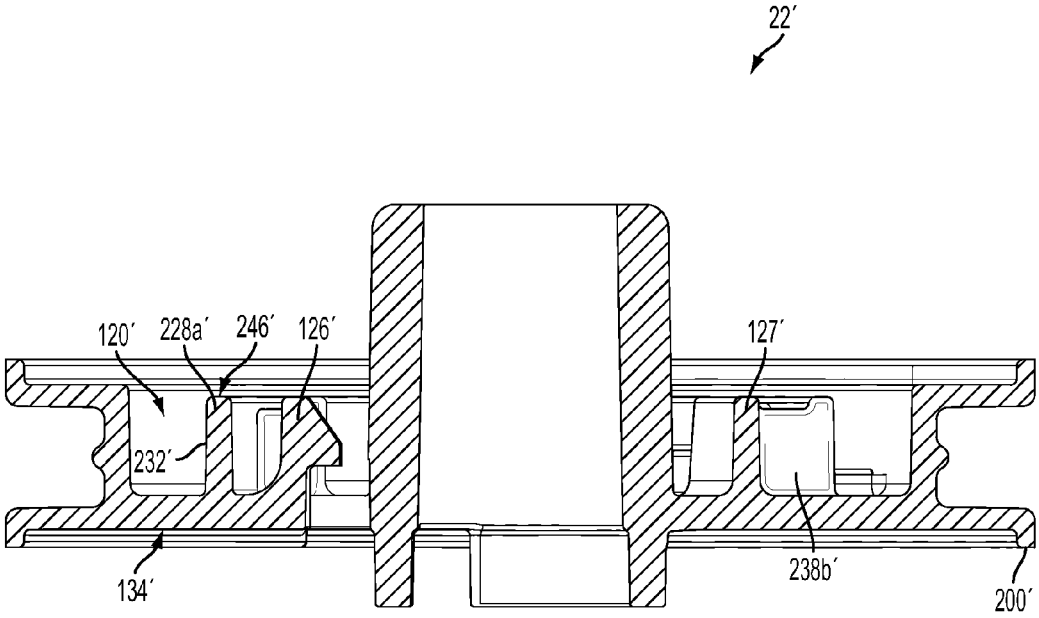
FIG. 36 is a cross-sectional view taken of the pulley member generally along line 36-36 in FIG. 31.
Figure 37:
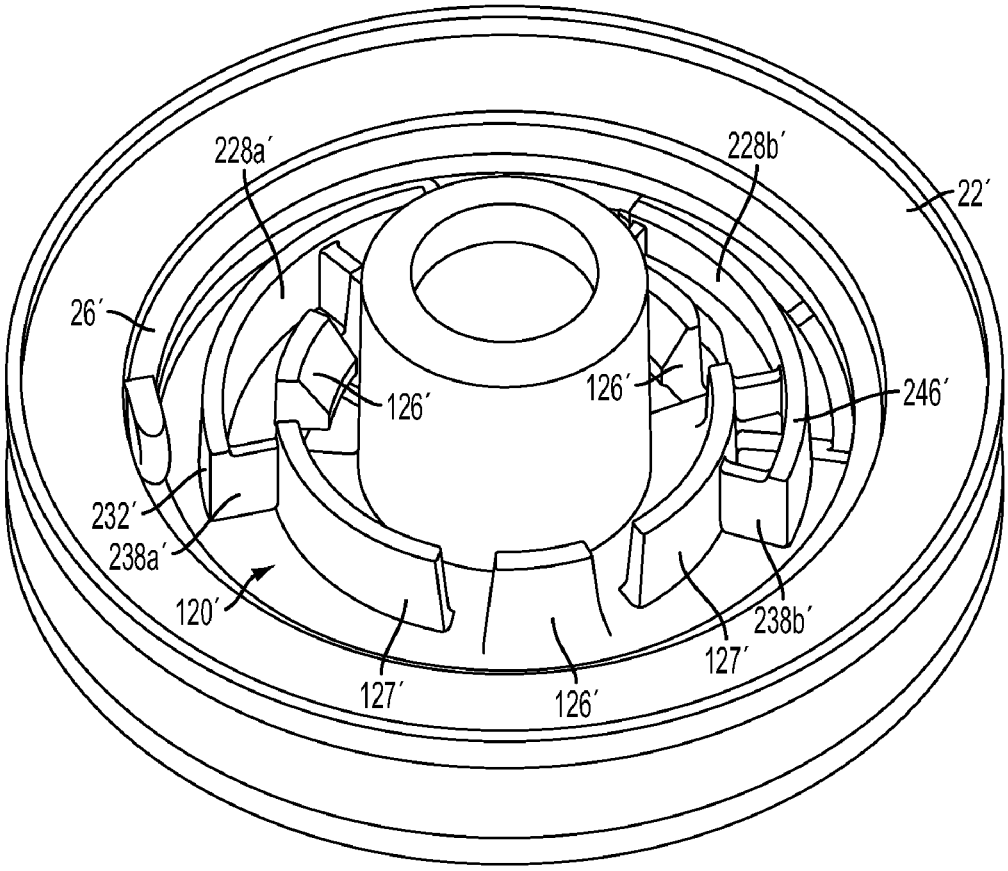
FIG. 37 is a top perspective view of the recoil starter system shown in FIG. 21 with the drive member removed for clarity.
Figure 38:
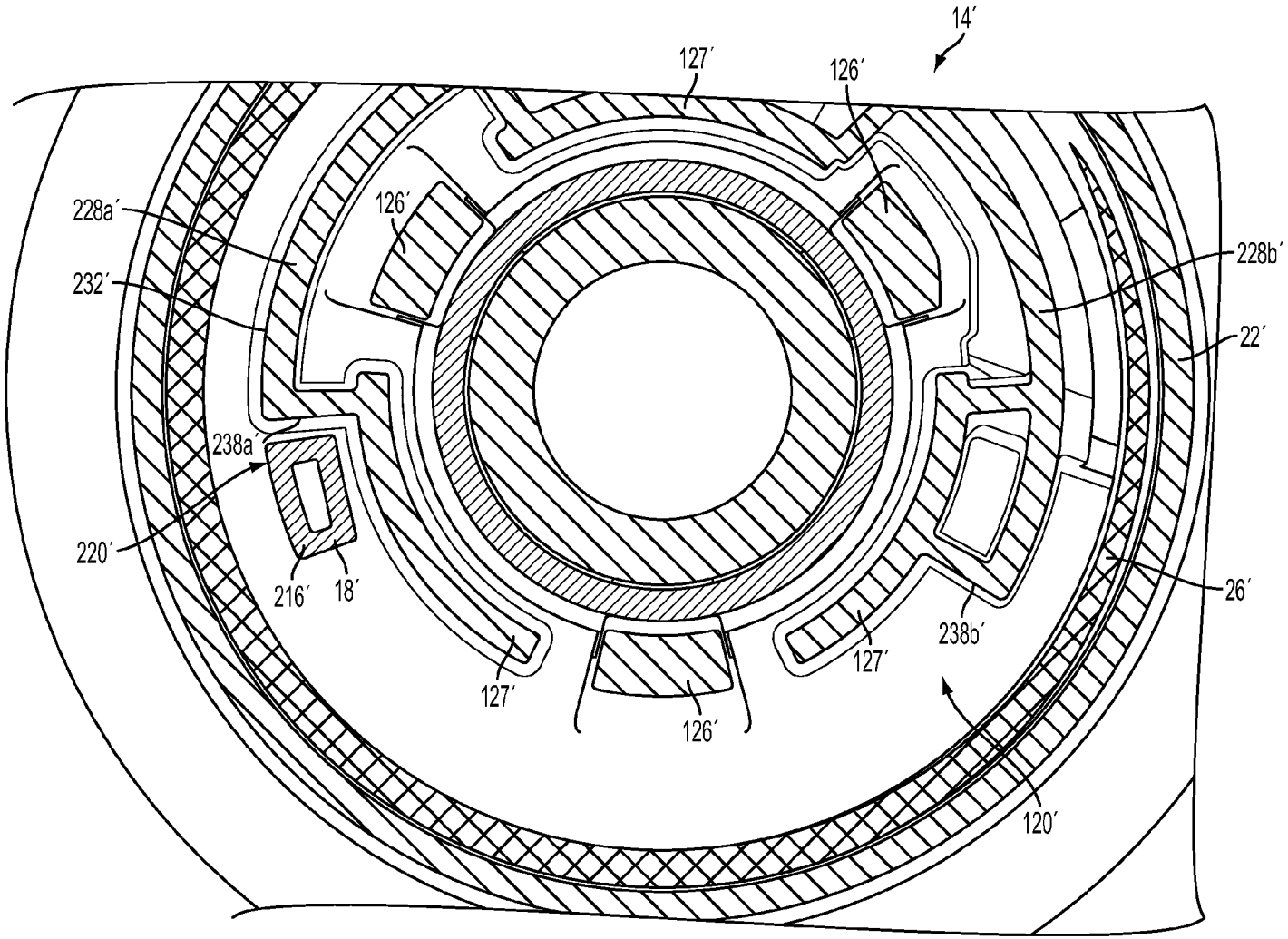
FIG. 38 is an enlarged cross-sectional view of the recoil starter system taken generally along line 38-38 of FIG. 34.
Figure 39:
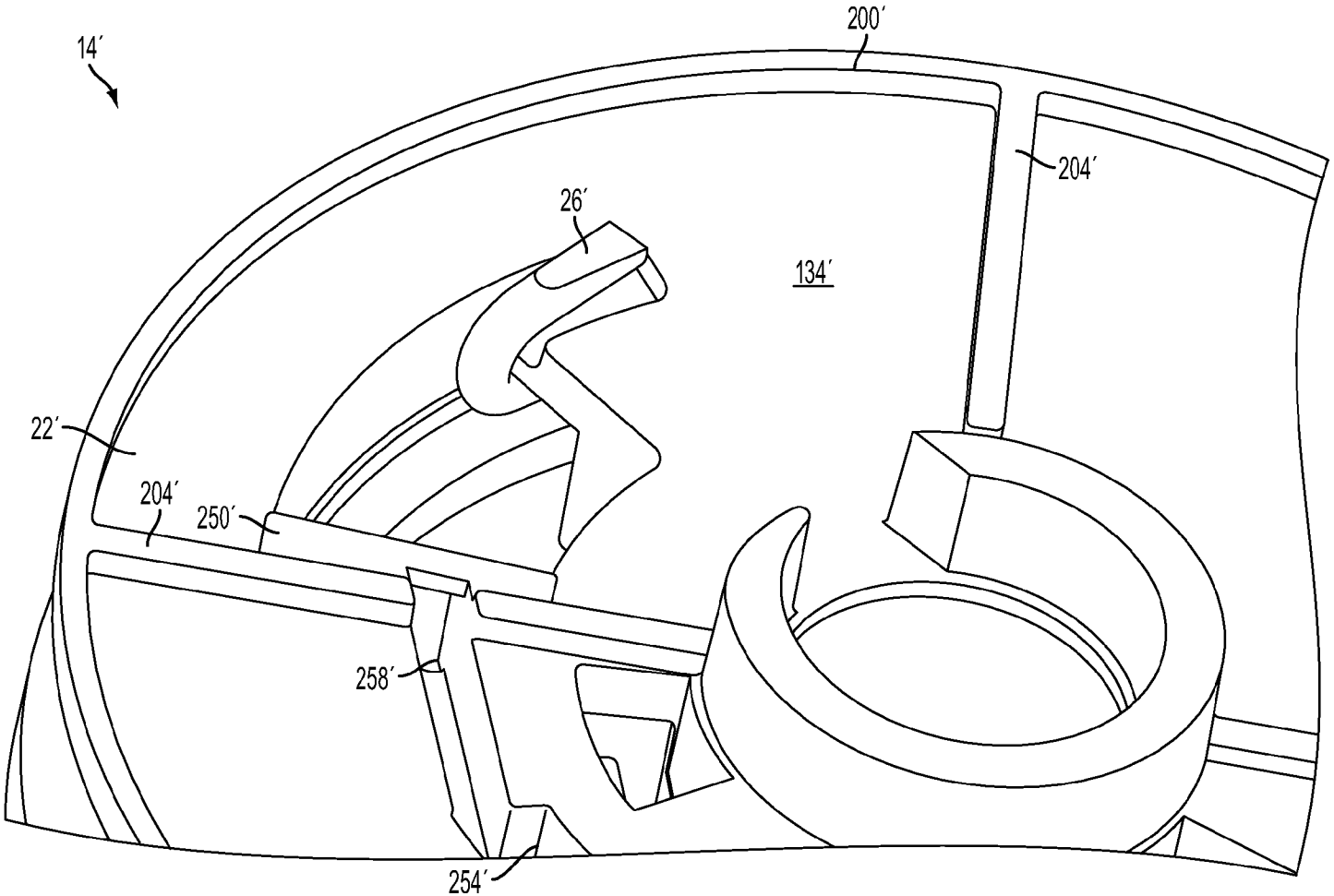
FIG. 39 is an enlarged bottom perspective view of the recoil starter system shown in FIG. 21.
Figure 40:
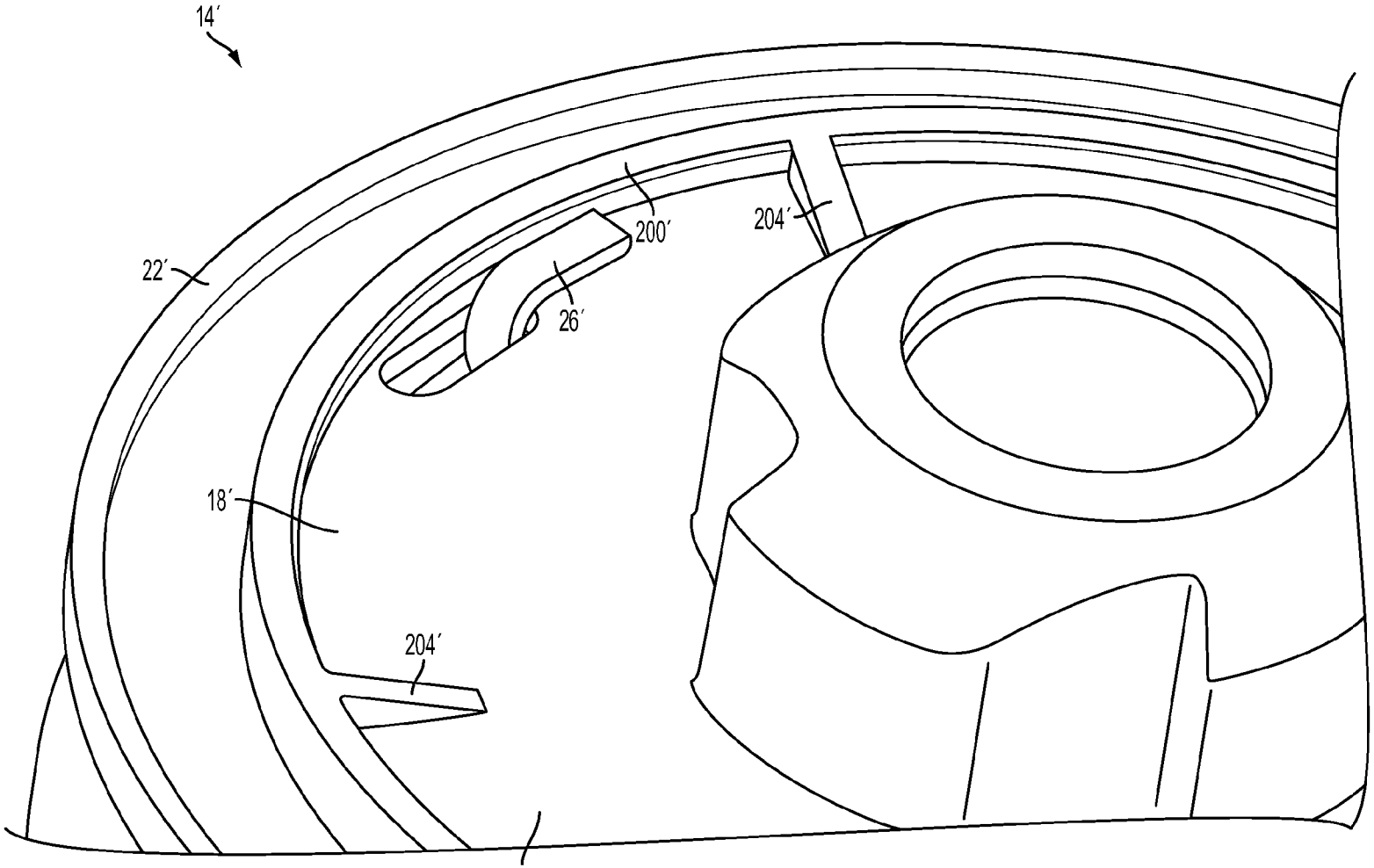
FIG. 40 is an enlarged top perspective view of the recoil starter system shown in FIG. 21.

The body portion 150 is positioned in the cavity 120, and, as shown in FIGS. 18-19, the spring support 146 engages the body portion 150 to prevent tilting of the spring member 26. As shown in FIGS. 1 and 3, the first leg 164 extends through the recess 50, and the first engaging portion 172 engages the slot 54 on the drive member 18. As shown in FIGS. 2 and 4, the second leg 168 extends through the recess 138, and the second engaging portion 176 engages the slot 136 on the pulley member 22.

In the illustrated construction, engagement of the engaging portions 172, 176 with the outer surfaces 42, 134 of the drive member 18 and the pulley member 22 also inhibits relative axial movement of the members 18 and 22. Accordingly, the spring member 26 may provide at least a portion of the connecting arrangement for the recoil starter system 14.

In the illustrated construction, the spring member 26 transmits torque input from the pulley member 22 to the drive member 18. Engagement of the axially extending legs 164, 168 with the walls of the recesses 50, 138 to pivotally bias the drive member 18 and the pulley member 22. The spring member 26 may be constructed to allow relative pivoting movement greater than 90 degrees between the drive member 18 and the pulley member 22.

In other constructions, the spring member 26 may be provided by more than one spring member engaged between the members 18, 22. The spring member 26 may be a different type of spring, such as a torsion spring. Also, the spring member 26 may be provided by a different type of spring member, such as an elastomeric member.

The recoil starter system 14 is assembled as a unit. The spring member 26 is connected to the drive member by inserting the first engaging portion 172 through the recess 50 and engaging the slot 54. The drive member 18 and the pulley member 22 are aligned and axially engaged. The first retainer 80 engages the second retainer 124, causing the tabs 126 to flex as the first retainer 80 passes and then return to fully engage the first retainer 80 thereby axially connecting the drive member 18 and the pulley member 22. As the members 18, 22 are engaged, the second engaging portion 176 of the spring member 26 is inserted through the recess 138. The drive pulley 22 is then pivoted relative to the spring member 26 and the drive member 18 so that the engaging portion 176 engages the slot 136.

Once assembled, the recoil starter system 14 is connected to other components (e.g., the pull cord) and to the engine. The free end of the pull cord is received in the cord retention recess 108, and the cord is wound in the radial groove 102 on the pulley member 22. The pulley member 22 is connected to the recoil spring and supported on the housing with a support received in the central opening 98. The drive member 18 is positioned for engagement with the engine.

In operation, the pulling force on the pull cord is transferred into the pulley member 22. The resulting torque is transmitted to the spring member 26 and subsequently transferred to the drive member 18. The drive member 18 then transmits the torque to the clutch mechanism to rotate the drive shaft of the engine. The spring member 26 absorbs fluctuations in pulling torque produced by the engine to allow the operator to experience a smooth and constant pulling force. The recoil spring causes the recoil starter system 14 to return to the starting position. When the engine starts, the clutch mechanism is disengaged from the recoil starter system 14.

FIGS. 21-42 illustrate an alternative construction of the recoil starter system 14'. In the illustrated alternative construction, the recoil starter system 14' employs much of the same structure and has many of the same properties as the previously-described recoil starter system 14 shown in FIGS. 1-20. Common elements have been given the same reference number "". The following description of the recoil starter system 14' focuses primarily upon structure and features different than the previously-described construction. Reference is made to the description of the recoil starter system 14 above for details of the structures and operation, as well as alternatives to the structures and operation, of the recoil starter system 14' not specifically discussed herein.

As best shown in FIGS. 21, 23, 25, 28-29 and 40-41, the drive member 18' includes a reinforcing rib 200' extending substantially perpendicular to the top surface 42' and substantially about the outer perimeter of the plate 30'. The reinforcing rib 200' provides additional rigidity to the drive member 18', for example, limiting or preventing unwanted or excessive flexing of the plate 30' during operation of the recoil starter system 14'. A plurality of secondary reinforcing ribs 204' extend radially inwardly from the reinforcing rib 200' to, for example, help maintain the reinforcing rib 200' in a perpendicular orientation relative to the top surface 42' of the plate 30'.

As shown in FIGS. 22, 24, 26, 32-33 and 39, in the illustrated construction, the pulley member 22' also includes a combination of a reinforcing ribs 200' and secondary reinforcing ribs 204'. In the illustrated embodiment, the secondary reinforcing ribs 204' on the pulley member 22' extend a distance toward the axis to provide additional support to the reinforcing ribs 200' and the pulley member 22'. In other constructions (not shown), the reinforcing ribs 200' and/or secondary reinforcing ribs 204' on the drive member 18' and/or the pulley member 22' may have a different shape, configuration, etc.

The drive member 18' also includes a first spring support member 208' extending from the bottom surface 46' of the plate 30' into cavity 120'. The first spring support 208' has an outer surface 224' with a first outer diameter 212' (see FIGS. 26-27, 29, 41-42). The first spring support member 208' provides at least a portion of a radially inner support for the spring member 26' to limit the amount of deformation of the spring member 26' during operation of the recoil starter system 14'. In the illustrated construction, the outer diameter 212' of the first spring support member 208' substantially corresponds to the inner diameter of the spring member 26' (see FIG. 41). As described below in more detail, the first spring support member 208' cooperates with a second spring support member 228'.

As shown in FIGS. 25-27, 29 and 38, a rotation limiting member 216' (e.g., a post, tab, etc.) extends into the cavity 120' beyond the first spring support member 208' to be engageable with a pair of travel stops 238*a*', 238*b*' (described below in more detail) to limit the maximum relative rotation between the drive member 18' and the pulley member 22' in each rotational direction. In the illustrated construction, the radially outer surface 220' of the rotation limiting member 216' substantially corresponds to the outer surface 224' of the first spring support member 208' so the outer surface 220' may also support to the spring member 26' during operation of the recoil starter system 14'.

As shown in FIGS. 25, 30-31, 34, 36-38 and 41-42, the pulley member 22' includes a plurality (e.g., three) of generally equally spaced tabs 126', a plurality of arcuate walls 127' spanning between the tabs 126', and a second spring support member 228' positioned radially outward of the arcuate walls 127' to provide a radially-inner support to the spring member 26'. In the illustrated construction, the second spring support member 228' includes first and second sections 228*a*', 228*b*' each spanning generally 90 degrees and having a second outer diameter 232' substantially corresponding to the first outer diameter 212' of the first spring support member 208' (see FIG. 41). Each section 228*a*', 228*b*' terminates to provide a corresponding travel stop 238*a*', 238*b*', as described in greater detail below.

Figure 41:
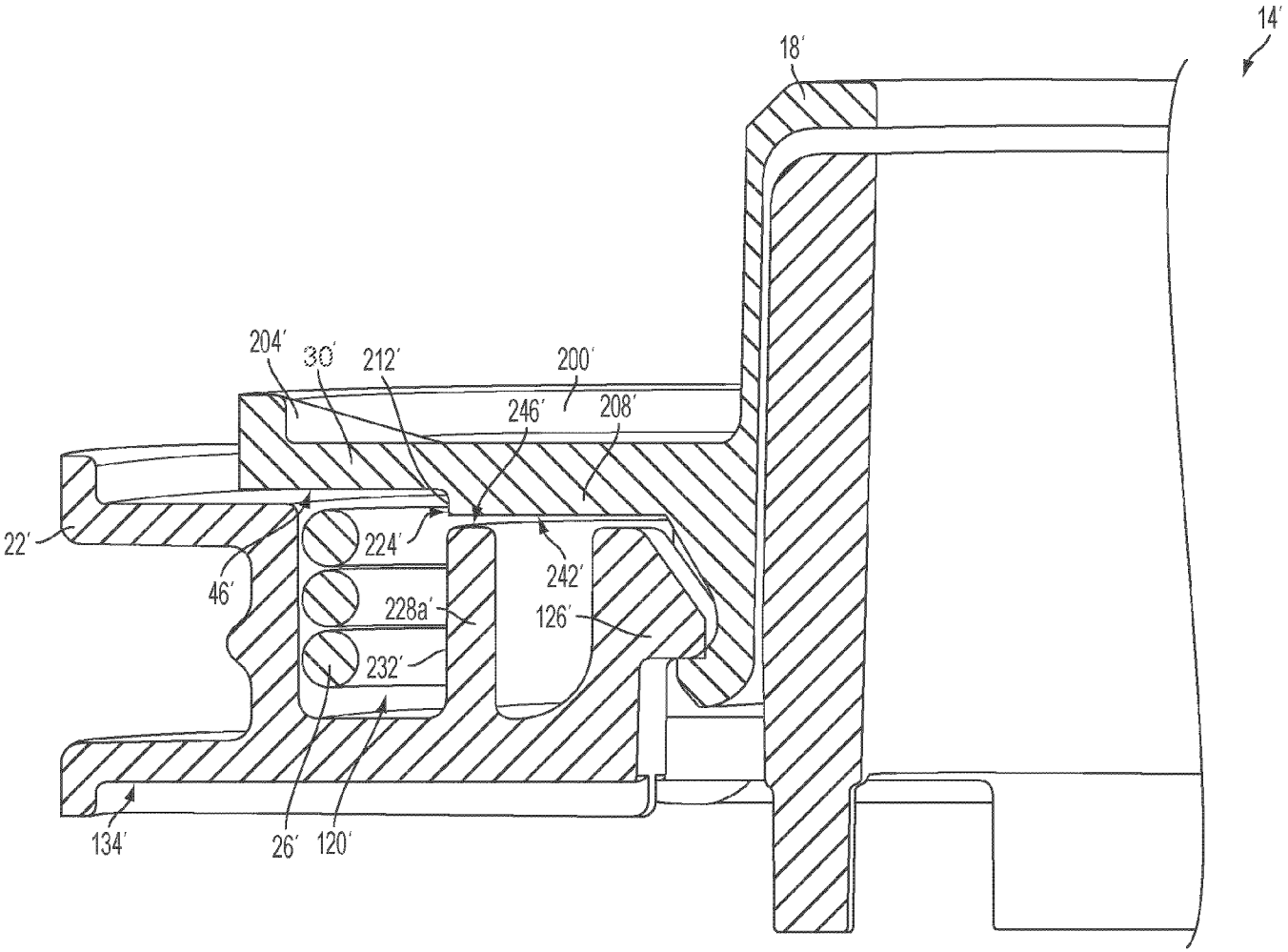
FIG. 41 is an enlarged cross-sectional view of the recoil starter system taken generally along line 41-41 of FIG. 23.
Figure 42:
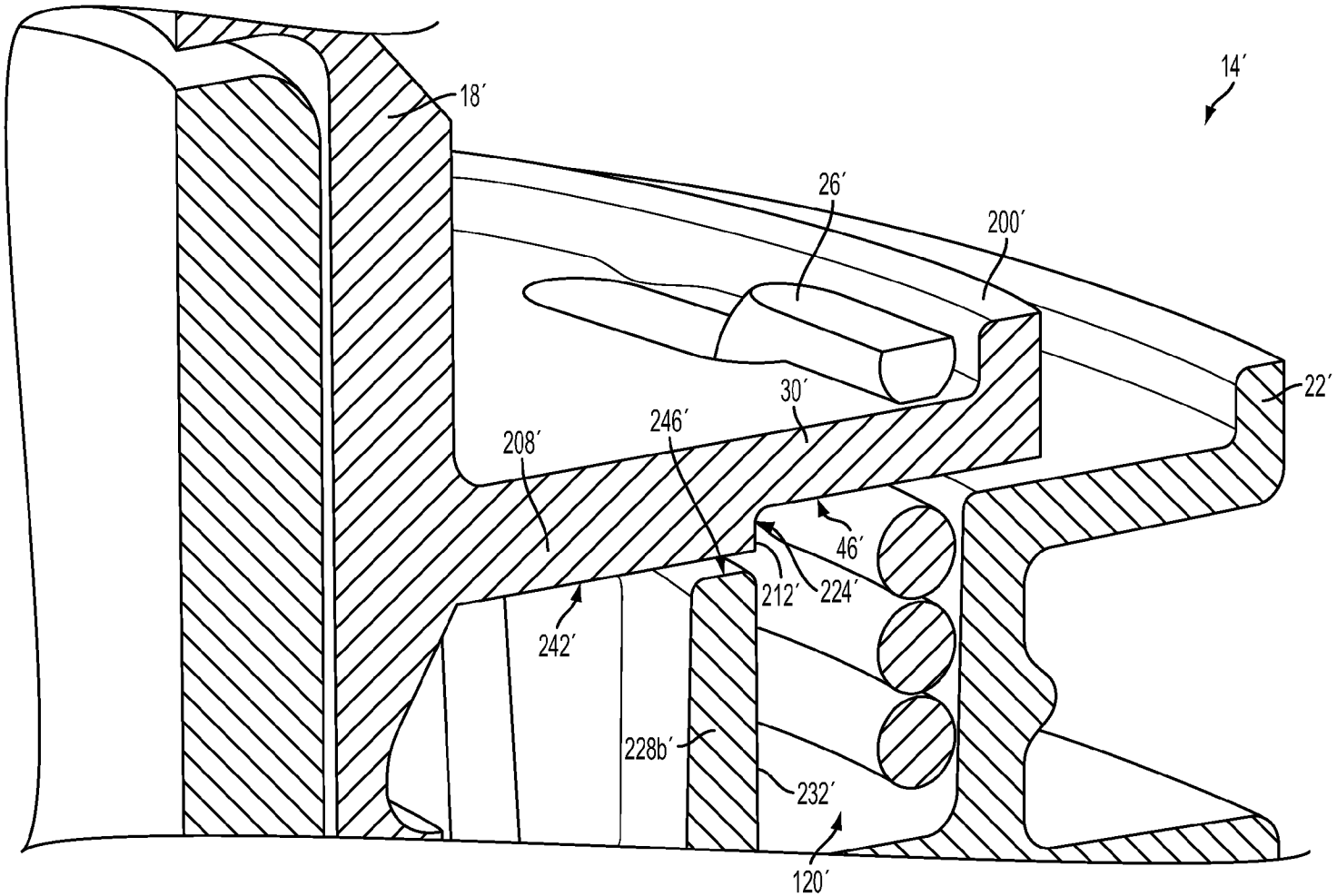
FIG. 42 is an enlarged cross-sectional view of the recoil starter system taken generally along line 42-42 of FIG. 23.

As shown in FIGS. 41-42, the support members 208', 228' cooperate to provide a radially-inner support or boundary for the spring member 26'. The lower surface 242' of the first spring support member 208' is sufficiently close to the upper surface 246' of the second spring support member 228' so that the two members effectively produce a radially-inner support extending substantially the height of the cavity 120'. The combined support limits the extent the spring member 26' may deflect during operation of the recoil starter 14'.

The travel stops 238*a*', 238*b*' are configured to engage the rotation limiting member 216' and to thereby limit the relative rotation between the drive member 18' and the pulley member 22' in each rotational direction. The travel stops 238*a*', 238*b*' generally extend substantially radially inwardly from the second spring support member 228', at a location corresponding to the radial position of the rotation limiting member 216'. The travel stops 238*a*', 238*b*' are spaced a distance from one another corresponding to the maximum allowable relative rotation between the two members 16', 22' without causing damage and/or undue wear to the spring member 26'. In the illustrated construction, the travel stops 238*a*', 238*b*' are spaced apart by about 140 degrees (see FIGS. 31 and 37-38).

As shown in FIGS. 24, 32-33, and 39, the rope retention cavity 254' of the pulley member 22' includes a rope retention bar 250'. In the illustrated construction, the rope retention bar 250' effectively encloses the distal end 258' of the rope retention cavity 254' to secure the end E of the pull rope R within the cavity 254'. By enclosing the distal end 258' of the rope retention cavity 254', the rope retention bar 250' assures the rope R cannot free itself from the cavity 254' without removing a retention mechanism (e.g., knot, stopper, etc.) from the rope R. In alternative constructions, the rope retention bar 250' may only partially enclose the distal end 258' of the cavity 254'.

One or more independent features or independent advantages of the invention may be set forth in the following claims.

What is claimed is:

1. A recoil starter system comprising:

a drive member engageable with an engine, the drive member including a plate having a bottom surface, and a first spring support extending from the bottom surface of the plate, the first spring support having a first outer surface with a first outer diameter;

a pulley member rotatably coupled to the drive member and including a second spring support, the second spring support having a second outer surface with a second outer diameter; and a spring member coupled between the drive member and the pulley member, the first spring support and the second spring support cooperating to provide a radially-inner support for the spring member.

2. The system of claim 1, wherein the first outer diameter and the second outer diameter are substantially the same diameter.

3. The system of claim 1, wherein the second spring support includes a plurality of arcuate walls each extending along a portion of the second outer diameter.

4. The system of claim 1, wherein the pulley member further includes a pair of spaced apart travel stops, and wherein the drive member further includes a rotation limiting member extending from the bottom surface of the plate axially beyond the first spring support, the rotation limiting member moving between and engaging each travel stop to limit relative rotation between the drive member and the pulley member in each direction.

5. The system of claim 4, wherein the travel stops are at least partially formed by the second spring support.

6. The system of claim 5, wherein the rotation limiting member has a radially outer surface radially aligned with a corresponding portion of the outer surface of the first spring support.

7. The system of claim 1, wherein at least one of the pulley member and the drive member includes one or more reinforcing ribs.

8. The system of claim 1, wherein the drive member and the pulley member define a cavity therebetween, the cavity having a height, and wherein the first support member and the second support member cooperate to extend substantially the height of the cavity.

9. The system of claim 1, wherein the drive member includes a first retainer, and wherein the pulley member includes a second retainer engageable with the first retainer to connect the pulley member to the drive member and to inhibit relative axial movement between the pulley member and the drive member.

10. The system of claim 1, wherein the spring member is connected between the drive member and the pulley member to inhibit relative axial movement between the drive member and the pulley member.

11. A recoil starter system comprising:

a drive member engageable with an engine;

a pulley member rotatably coupled to the drive member, the drive member and the pulley member cooperating to define a cavity therebetween;

a spring member coupled between the drive member and the pulley member; and a rotation limiting arrangement provided between the drive member and the pulley member, the rotation limiting arrangement including a pair of travel stops supported by one of the drive member and the pulley member within the cavity, the travel stops being circumferentially spaced apart, and a rotation limiting member supported by the other of the drive member and the pulley member in the cavity, the rotation limiting member moving between and being configured to engage each travel stop to limit relative rotation between the drive member and the pulley member in each direction.

12. The system of claim 11, wherein the one of the travel stops provides a first stop surface and the other of the travel stops provides a second stop surface, and wherein the rotation limiting member has a first surface and an opposite second surface, the first surface being engageable with the first stop surface to limit relative rotation between the drive member and the pulley member in a first direction, the second surface being engageable with the second stop surface to limit relative rotation between the drive member and the pulley member in a second direction opposite the first direction.

13. The system of claim 12, wherein the first stop surface and the second stop surface are circumferentially spaced apart by about 140 degrees.

14. The system of claim 11, wherein the travel stops are supported by the pulley member, and wherein the rotation limiting member is supported by the drive member.

15. The system of claim 14, wherein the drive member includes a plate with a bottom surface, and a drive member spring support extending from the bottom surface, the drive member spring support having an outer surface with an outer diameter, the drive member spring support providing a radially-inner support for at least a portion of the spring member, and wherein the rotation limiting member has a radial outer surface radially aligned with a corresponding portion of the outer surface of the drive member spring support.

16. The system of claim 14, wherein the pulley member includes a pulley member spring support having an outer surface with an outer diameter, the pulley member spring support providing a radially-inner support for at least a portion of the spring member, the travel stops being at least partially formed by the pulley member spring support.

17. The system of claim 16, wherein the drive member includes a plate with a bottom surface, and a drive member spring support extending from the bottom surface, the drive member spring support having an outer surface with an outer diameter, the drive member spring support providing a radially-inner support for another portion of the spring member.

18. The system of claim 11, wherein the drive member includes a first retainer, and wherein the pulley member includes a second retainer engageable with the first retainer to connect the pulley member to the drive member and to inhibit relative axial movement between the pulley member and the drive member.

19. The system of claim 11, wherein the spring member is connected between the drive member and the pulley member to inhibit relative axial movement between the drive member and the pulley member.

20. A recoil starter system comprising:

a drive member engageable with an engine; and a pulley member pivotably coupled to the drive member, the pulley member being rotatable by a pull rope, force generated by rotation of the pulley member being transmitted to the drive member, the drive member transmitting rotational force to the engine to start the engine, the pulley member including a body defining an outwardly-facing radial groove for receiving a wound portion of the pull rope, and a rope retention recess for receiving an end of the pull rope, the pull rope being arranged on the pulley member to extend from the first end in the rope retention recess and into the radial groove, the body providing a rope retention bar across and enclosing the rope retention recess to secure the end of the pull rope within the rope retention recess.

* * * * *